US008152081B2

(12) United States Patent
Herrera

(10) Patent No.: US 8,152,081 B2
(45) Date of Patent: Apr. 10, 2012

(54) COMMINUTING MACHINE CONTAINMENT SYSTEM

(75) Inventor: Javier Herrera, San Antonio, TX (US)

(73) Assignee: Harris Waste Management Group, Inc., Tyrone, GA (US)

( * ) Notice: Subject to any disclaimer, the term of this patent is extended or adjusted under 35 U.S.C. 154(b) by 125 days.

(21) Appl. No.: 12/551,138

(22) Filed: Aug. 31, 2009

(65) Prior Publication Data

US 2011/0036936 A1 Feb. 17, 2011

Related U.S. Application Data

(60) Provisional application No. 61/233,376, filed on Aug. 12, 2009.

(51) Int. Cl.
*B02C 17/16* (2006.01)

(52) U.S. Cl. ..... 241/27; 241/73; 241/189.1; 241/285.3

(58) Field of Classification Search ..... 241/27, 241/189.1, 73, 285.3
See application file for complete search history.

(56) References Cited

U.S. PATENT DOCUMENTS

| | | | | |
|---|---|---|---|---|
| 3,465,973 | A * | 9/1969 | Williams | 241/86.2 |
| 3,610,543 | A * | 10/1971 | Jensen | 241/73 |
| 3,915,395 | A * | 10/1975 | Graf | 241/101.71 |
| 4,226,375 | A * | 10/1980 | Cameron | 241/88.4 |
| 4,449,673 | A * | 5/1984 | Cameron | 241/186.35 |
| 4,830,291 | A * | 5/1989 | Williams | 241/73 |
| 5,062,575 | A * | 11/1991 | Barnabie et al. | 241/73 |
| 7,222,805 | B1 * | 5/2007 | Williams, Jr. | 241/89.1 |
| 7,900,858 | B2 * | 3/2011 | Ragnarsson | 241/32 |
| 2006/0086850 | A1 * | 4/2006 | Cohen et al. | 241/189.1 |
| 2007/0069053 | A1 * | 3/2007 | Ortoncelli | 241/189.1 |
| 2007/0241218 | A1 * | 10/2007 | Peterson et al. | 241/73 |
| 2010/0006683 | A1 * | 1/2010 | Fukuhiro | 241/189.1 |

* cited by examiner

*Primary Examiner* — Bena Miller
(74) *Attorney, Agent, or Firm* — Perman & Green, LLP

(57) ABSTRACT

A comminuting machine including a frame, an infeed conveyor connected to the frame, a hammer mill connected to the frame, the hammer mill including a hammer mill housing substantially surrounding the hammer mill, a containment system substantially surrounding a comminuting portion of the comminuting machine, the containment system includes at least one cage, the at least one cage including a cage frame extending to substantially block projectile travel paths through openings of the comminuting machine, the cage frame being connected to the frame, and a drive unit movably coupled to the frame for effecting movement of the at least one cage relative to the comminuting portion of the comminuting machine without disconnecting the cage frame from the frame.

16 Claims, 17 Drawing Sheets

COMMINUTING MACHINE CONTAINMENT SYSTEM

CROSS REFERENCE TO RELATED APPLICATIONS

This application claims the benefit of provisional patent application Ser. No. 61/233,376 filed on Aug. 12, 2009, the disclosure of which is incorporated by reference herein in its entirety.

BACKGROUND

1. Field

The exemplary embodiments generally relate to comminuting machines and, more particularly, to containment systems for comminuting machines.

2. Brief Description of Related Developments

Generally comminuting machines, such as those used in the material handling industry, include a feed device for feeding comminuting feed material into, for example, a mill for breaking the comminuting feed material into smaller pieces. An opening generally exists between the feed device and the mill such that objects can enter or exit the comminuting machine without entering through the feed device or exiting through an outlet of the mill.

It would be advantageous to have a cage that bridges the opening between the feed device and the mill.

SUMMARY

In one exemplary embodiment, a comminuting machine is provided. The comminuting machine includes a frame, an infeed conveyor connected to the frame, a hammer mill connected to the frame, the hammer mill including a hammer mill housing substantially surrounding the hammer mill, a containment system substantially surrounding a comminuting portion of the comminuting machine, the containment system includes at least one cage, the at least one cage including a cage frame extending to substantially block projectile travel paths through openings of the comminuting machine, the cage frame being connected to the frame, and a drive unit movably coupled to the frame for effecting movement of the at least one cage relative to the comminuting portion of the comminuting machine without disconnecting the cage frame from the frame.

In another exemplary embodiment, a method for substantially blocking projectile travel paths in a comminuting machine is provided. The method includes providing an infeed conveyor, providing a hammer mill, the hammer mill including a hammer mill housing substantially surrounding the hammer mill, the infeed conveyor being disposed adjacent the hammer mill for conveying items to the hammer mill, substantially blocking projectile travel paths through openings of the comminuting machine by providing a containment system substantially surrounding a comminuting portion of the comminuting machine, the containment system including at least one cage including a cage frame extending to block the projectile travel paths, the cage frame being connected to the comminuting machine, and moving the at least one cage relative to the comminuting portion of the comminuting machine without disconnecting the cage frame from the comminuting machine for allowing access to comminuting machine components.

In yet another exemplary embodiment, a comminuting machine is provided. The comminuting machine includes a frame, comminuting machine components mounted to the frame, the comminuting machine components including a hammer mill having a hammer mill housing substantially surrounding the hammer mill, a containment system substantially surrounding a comminuting portion of the comminuting machine, the containment system includes at least one cage, the at least one cage including a cage frame extending to substantially block projectile travel paths through openings between the comminuting machine components, the cage frame being connected to the frame, and a drive unit movably coupled to the frame for effecting movement of the at least one cage relative to the comminuting machine components without disconnecting the cage frame from the frame.

BRIEF DESCRIPTION OF THE DRAWINGS

The foregoing aspects and other features of the disclosed embodiments are explained in the following description, taken in connection with the accompanying drawings, wherein.

DETAILED DESCRIPTION OF THE EXEMPLARY EMBODIMENT(S)

Figure 1A:
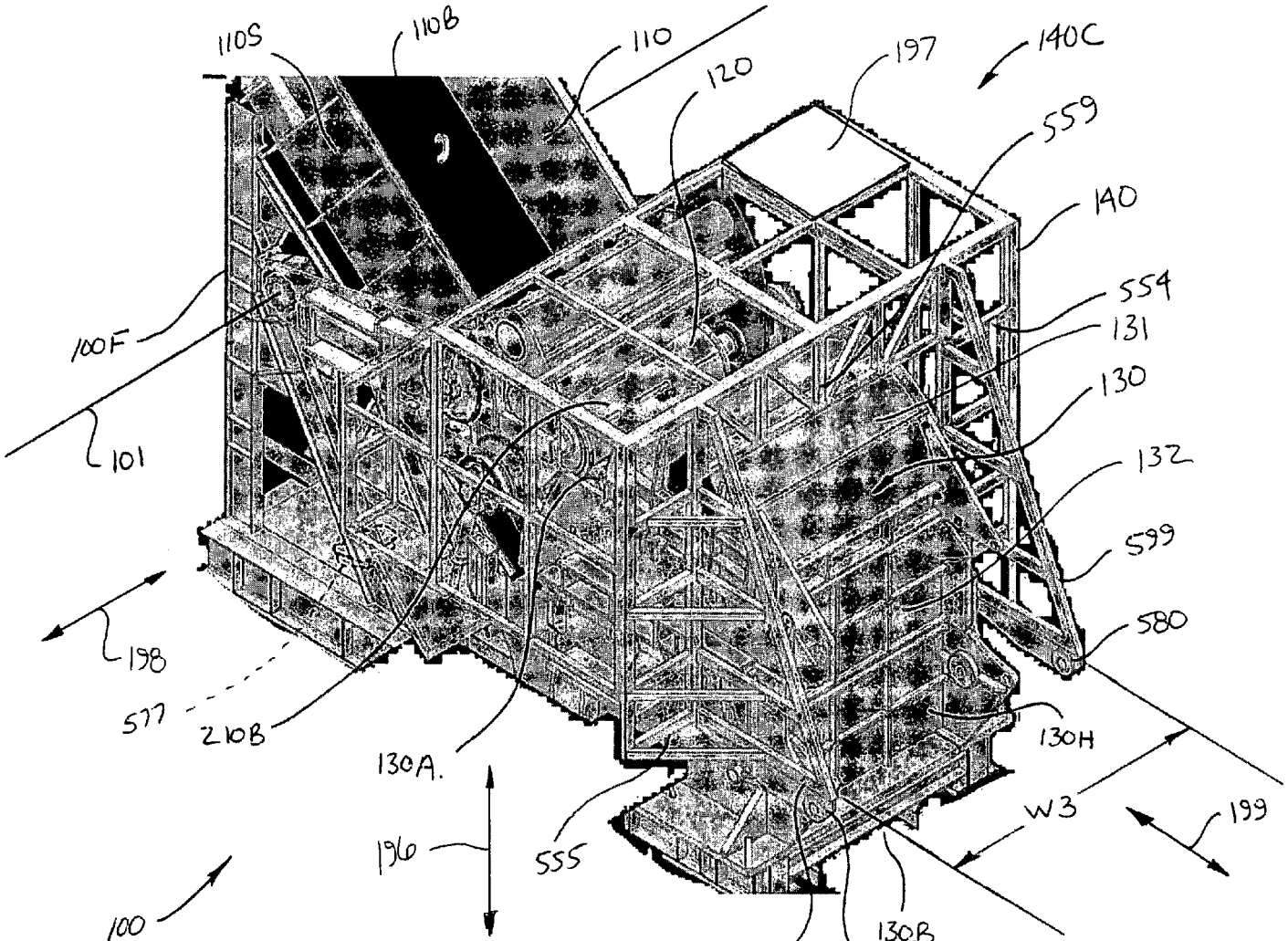
FIGS. 1-1C are schematic illustrations of a portion of comminuting machine in accordance with an exemplary embodiment.
Figure 1B:
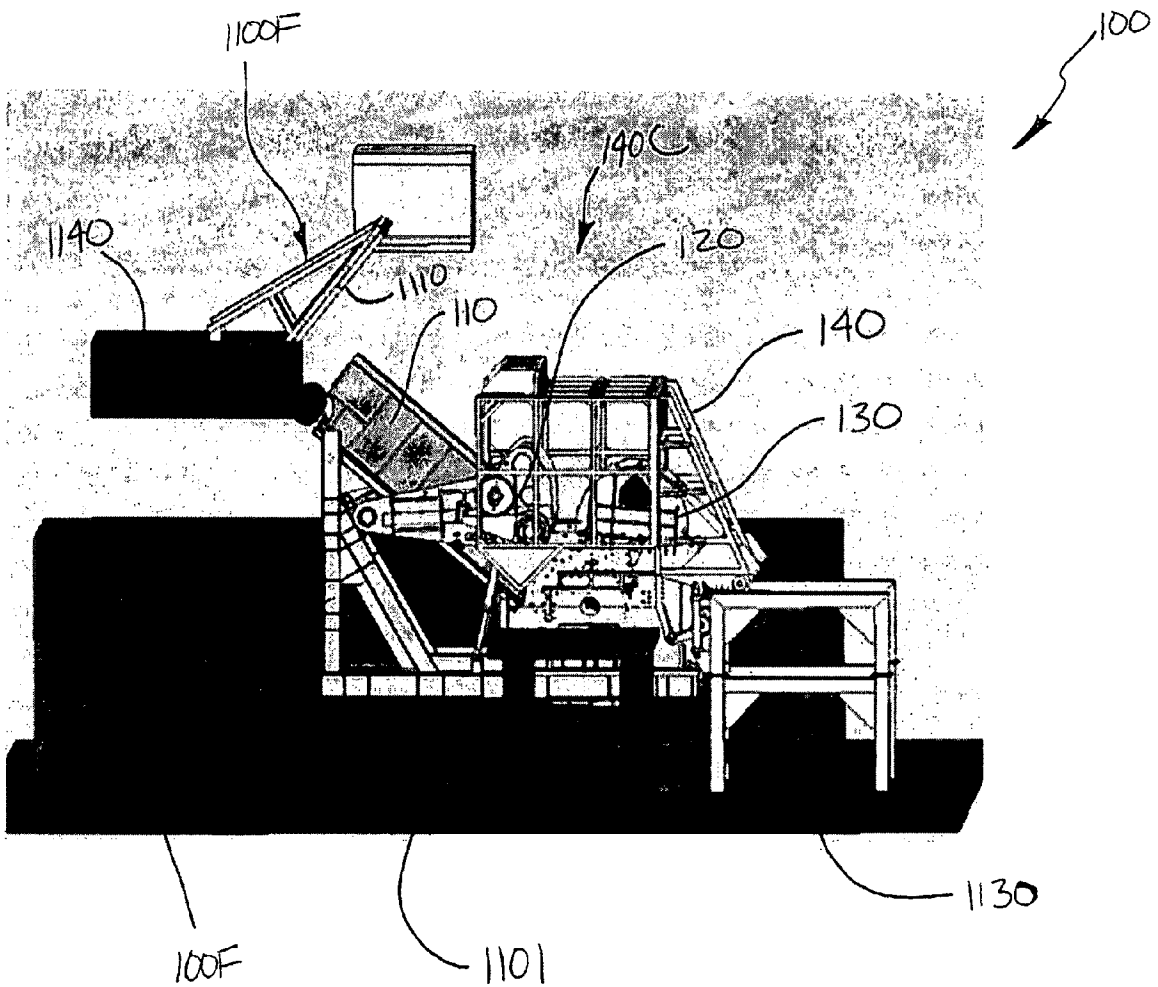

FIGS. 1A and 1B illustrate portions of a comminuting machine 100 in accordance with an exemplary embodiment. Although the disclosed embodiments will be described with reference to the drawings, it should be understood that the disclosed embodiments can be embodied in many alternate forms. In addition, any suitable size, shape or type of elements or materials could be used.

In this exemplary embodiment, the comminuting machine 100 is configured as a hammer mill shredder for exemplary purposes only. It should be understood that the exemplary embodiments described herein may be applied to any suitable comminuting machine without departing from the scope of the exemplary embodiments. In this example, the comminuting machine 100 may be configured for "shredding" or otherwise breaking up any suitable comminuting feed materials such as for material management, reclamation or recycling purposes. Here the comminuting machine 100 includes a frame 100F, a feed chute 110 that is fed by an infeed conveyor 1140, a feed roll 120, a shredder 130, an outfeed conveyor 1130, a containment system 140C and one or more drive units (referred to generally as "components" of the comminuting machine). It is noted that in alternate embodiments the comminuting machine 100 may have any suitable configuration and components. The drive units may be configured for driving one or more components of the comminuting machine 100 as will be described in greater detail below. The frame 100F is configured in any suitable manner for supporting the components of the comminuting machine 100, such as those described herein. In one example, the frame 100F may be mounted on, for example, a foundation or other suitable footing 1101 and the components may be mounted to the frame 100F in any suitable manner, such as on platforms or other suitable mounting features disposed on the frame 100F. The containment system 140C is configured to minimize a number of projectiles or particles being ejected from the comminuting machine 100 and passing outside the containment system boundary substantially without interference to feeding and discharge from the comminuting machine 100 as will be described further below.

The feed chute 110 includes a base 110E and side walls 110S which in this example for a substantially U-shaped channel. The feed chute 110 may be mounted to the frame 100F at any suitable angle for allowing comminuting feed material to slide down the substantially U-shaped channel of the feed chute 110 by, for example, gravity so that the comminuting feed material substantially contacts the feed roller 120. In alternate embodiments the feed chute 110 may include a conveyor or any other suitable material transport for providing comminuting feed material to the feed roller. In still other alternate embodiments the feed chute 110 may have any suitable shape for conveying comminuting feed material to the feed roller 120.

Figure 2:
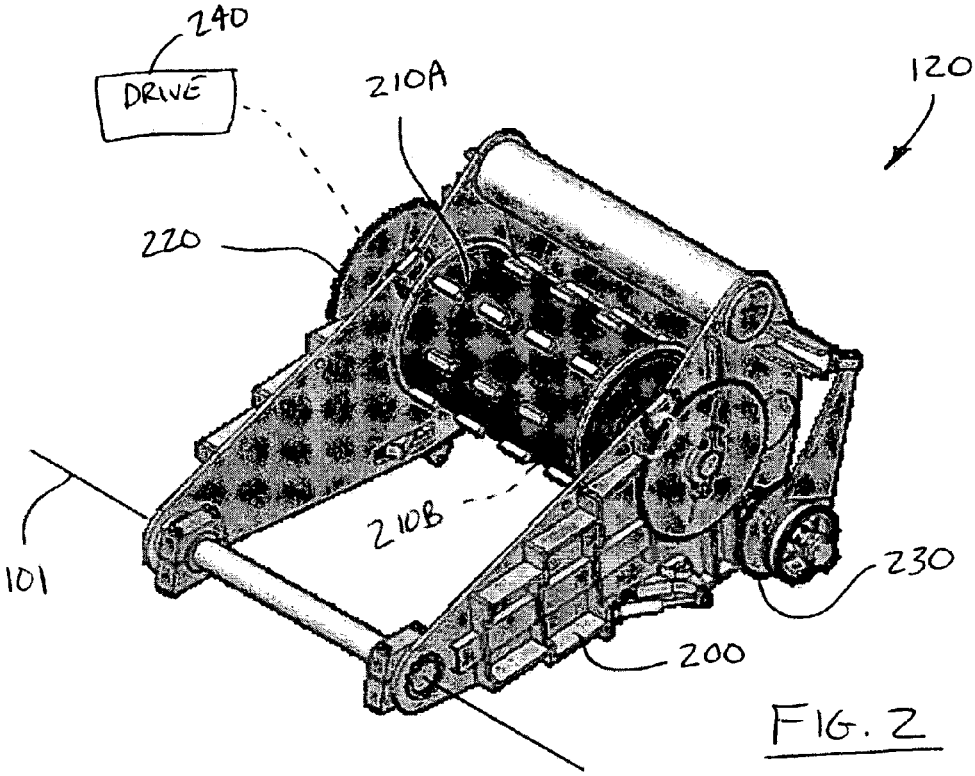
FIG. 2 is a schematic illustration of a portion of the comminuting machine of FIGS. 1A-1C.
Figure 3:
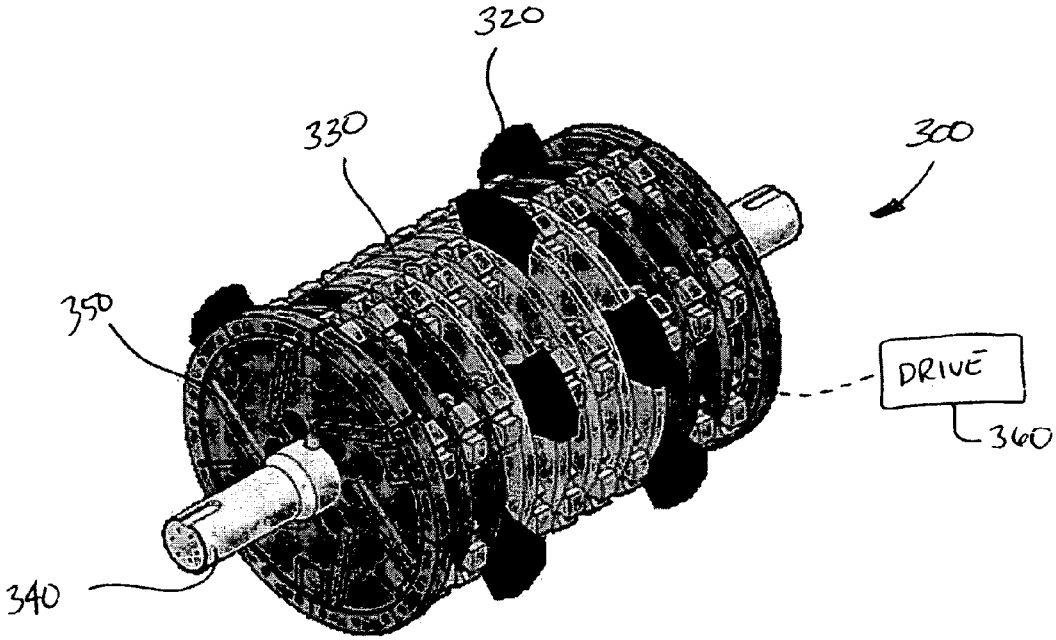
FIG. 3 is a schematic illustration of a portion of the comminuting machine of FIGS. 1A-1C.
Figure 4A:
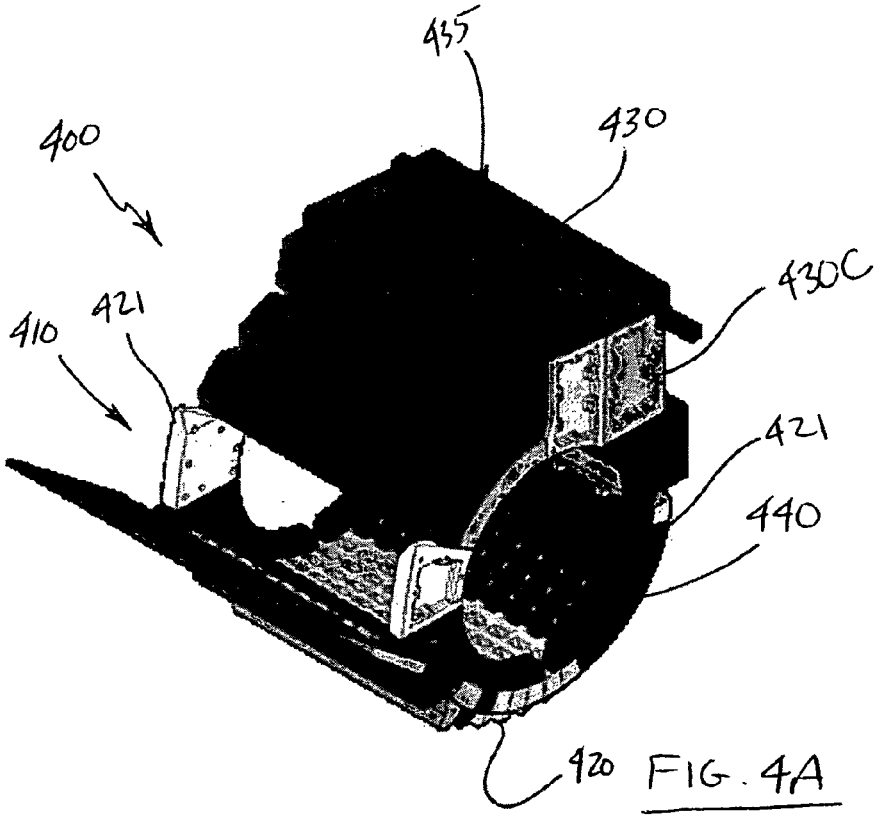
FIGS. 4A and 4B are schematic illustrations of a portion of the comminuting machine of FIGS. 1A-1C.
Figure 4B:
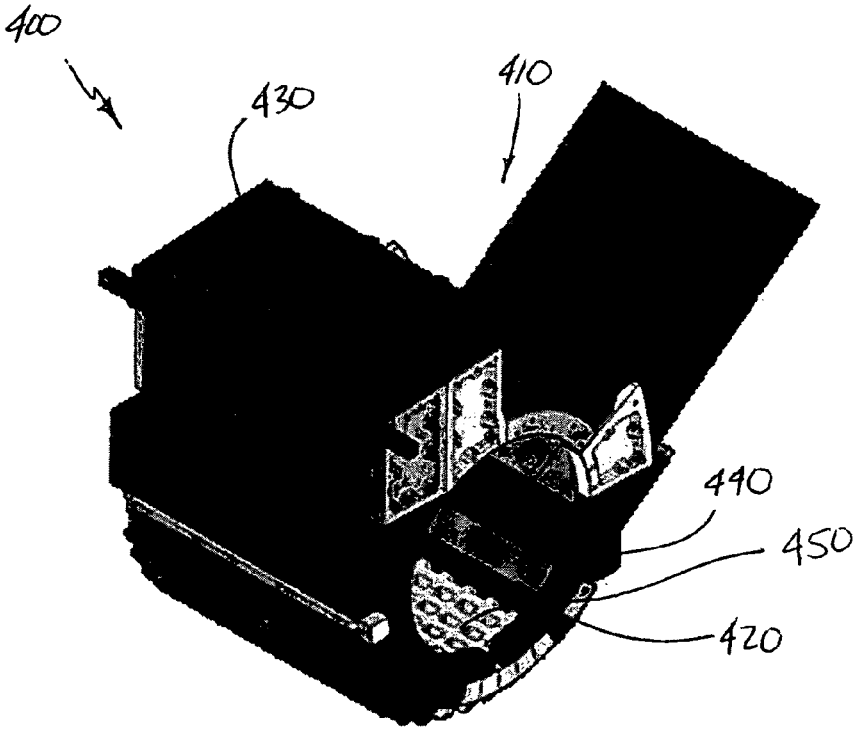
Figure 5:
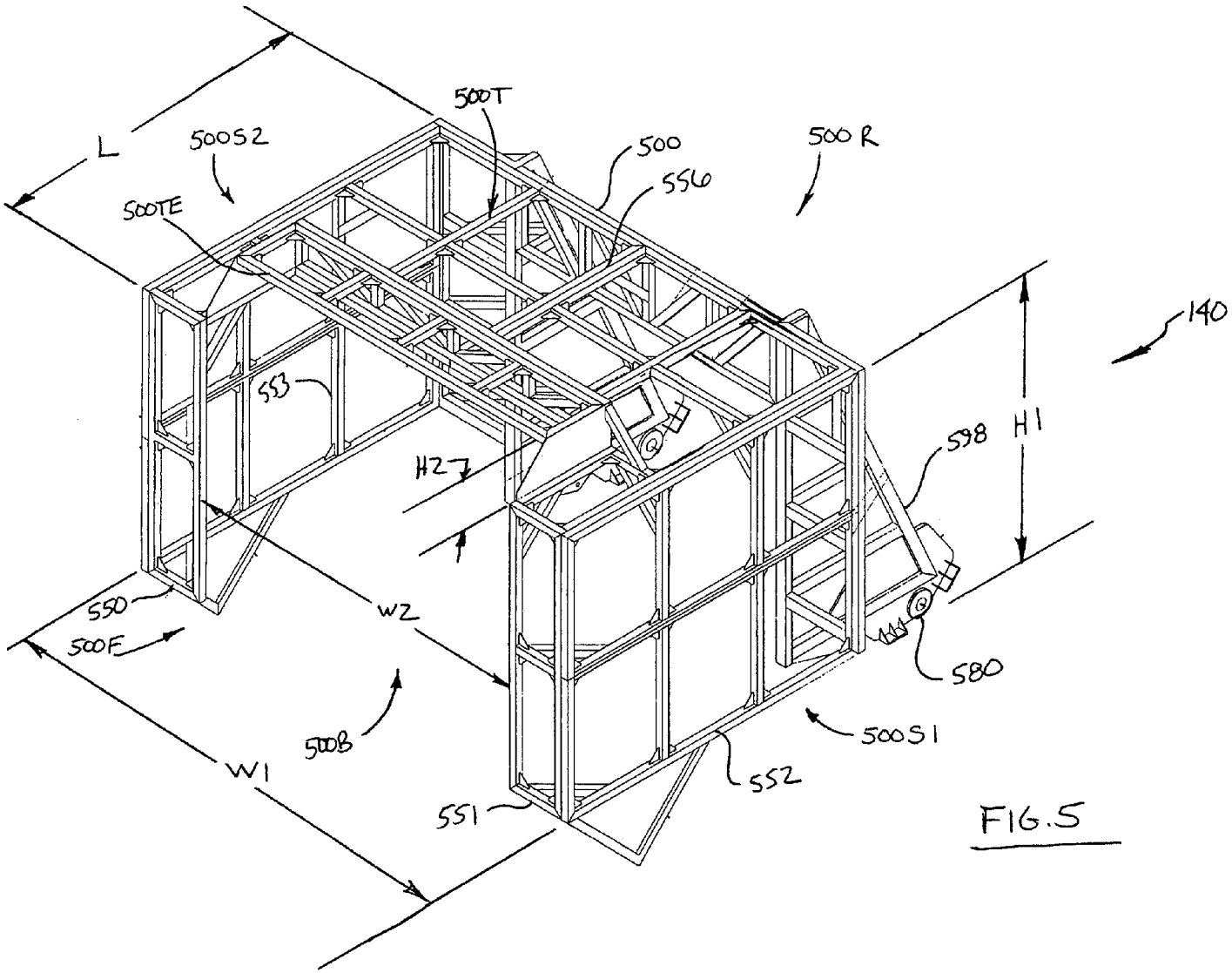
FIG. 5 is a schematic illustration of a cage in accordance with an exemplary embodiment.

Referring also to FIG. 2, in this exemplary embodiment the feed roller 120 is configured as a double feed roller with, for example, at least one hydraulic drive 240. In alternate embodiments the feed roller 120 may be any suitable feed roller having any suitable drive. Here the feed roller 120 includes a frame 200 and feed rolls 210A, 210B rotatably mounted to the frame 200. The frame 200 may comprise a yoke that is pivotally mounted to, for example, the feed chute 110 (or to any suitable location of the frame 100F of the comminuting machine 100) so that the feed rolls 210A, 210B can be pivoted up and down (via for example a hydraulic cylinder or other suitable drive) about, for example, axis 101 relative to the feed chute 110 for grabbing comminuting feed material or to help crush the comminuting feed material. Each of the feed rolls 210A, 210B may include one or more drive wheels 220 connected to the drive 240 by any suitable transmission. In alternate embodiments each of the feed rolls 210A, 210B may have a respective drive for directly or indirectly (e.g. through a transmission) driving the feed rolls. The feed rolls 210A, 210B may be configured with protrusions or teeth that grab the comminuting feed material located on the feed chute 110 so that the comminuting feed material is fed into the shredder 130 as the feed rolls 210A, 210B are rotated.

Referring to FIGS. 1A-1C, 3, 4A and 4B the shredder includes housing 130H, internal castings 400 and rotor 300. The housing 130H may include an upper housing portion 131 and a lower housing portion 132 configured to at least partially house internal castings 400 and rotor 300. In one example, the upper housing portion 131 may be movable (e.g. pivotally mounted) relative to the lower housing portion 132. Suitable drives may be connected to the housing 130H for effecting movement of the upper housing portion 131 relative to the lower housing portion 132 for allowing access to, for example the internal casting 400 and 300. In one example the housing portions 131, 132 may be constructed of welded steel but in alternate embodiments the housing may be constructed of any suitable material(s) and in any suitable manner, such as with fasteners or with a unitary one-piece construction. The housing 130H includes an inlet 130A configured to receive comminuting feed material from the feed roller 120 and an outlet 130B configured to provide comminuted or shredded material (e.g. comminuting discharge material) to, for example, the outfeed conveyor 1130.

The internal castings 400 may be constructed of, for example, any suitable material such as a work hardening material. The internal castings 400 may include circumferential grates 420, side walls 421 and an anvil 350 that substantially form a drum in which the rotor 300 rotates. The drum includes an inlet 410 and an outlet 435. The inlet is configured for accepting the comminuting feed material provided by the feed roller 120. The outlet may include an outlet chute 430C and a grate 430. The circumferential grates 420 and outlet grate 430 include apertures of a predetermined size such that as the comminuting feed material is shredded, pieces of material that are smaller than the apertures fall through the circumferential grates 420 (e.g. bottom material discharge) or are discharged out of the grate 430 (e.g. top material discharge) for passage through the housing outlet 130B. In one example, the internal castings 400 may also include a reject door configured to discharge unshreddable material from the shredder 130 before contacting the rotor 300. The anvil 450 is configured to provide a cutting edge for the rotor 300 as the comminuting feed material enters the shredder 130. It is noted that the configuration of the internal castings 400 and the drum formed thereby is exemplary only and in alternate embodiments the internal castings may have any suitable shape and configuration for allowing rotation of the rotor and the shredding of comminuting feed material as described herein.

The rotor 300 includes a shaft 340, rotor discs 330 and hammers 320. The rotor shaft 340 may be constructed of any suitable material and is suitably mounted to, for example, the shredder housing 130H in any suitable manner. In one example, the rotor shaft 340 may be supported within the shredder 130 by self-aligning spherical roller bearings. The rotor discs 330 may be keyed to the shaft 340 so that the shaft and the discs 330 substantially rotate as a unit. The rotor discs 330 may be constructed of any suitable material such as, for example, a wear resistant material. Spacers (not shown) separate the rotor discs 330 from each other on the shaft. The rotor discs 330 on the end of the shaft 340 (e.g. the "end discs") may include suitable wipers 350 for substantially preventing material accumulation between an internal wall of the shredder housing 130H and the end discs. The hammers 320 may have any suitable shape and size and be constructed of any suitable material. The hammers 320 may be pivotally mounted to the rotor discs 330 such that the hammers 320 are allowed to swing independent of each other and relative to the rotor discs 330. The rotor 300 may be rotated within the shredder by any suitable drive 360 at any suitable speed. As the rotor 300 is rotated the hammers 320 interact with the anvil 450 for shredding the comminuting feed material fed into the shredder 130. It is noted that the hammers 320 may also interact with the one or more of the grates 420, 430 for shredding the material. As described above, as the comminuting feed material is shredded and reduced in size the grates 420, 430 allow the shredded material to pass into and through the outlet 130B of the shredder 130.

Referring now to FIGS. 1A-1C, 5, 11 and 12 the containment system 140C will be described in accordance with exemplary embodiment. In one exemplary embodiment, the containment system 140C may include a front cage 1100F, a middle cage 140 and a rear cage 1120. In alternate embodiments the containment system 140C may include more or fewer cage components (i.e. the containment system could include a front and middle cage, or a middle and rear cage or any suitable combination of the front, middle and rear cages). In this example the containment system 140C is positioned to substantially block or substantially cover access ways and openings (e.g. feed and discharge openings) of the comminuting machine 100. The containment system 140C is arranged so that a minimum number of projectiles and particles are ejected from the comminuting machine 100 passing beyond the boundary of the containment system 140C, yet without substantial interference with access to the comminuting machine 100, or with feeding and discharge of material from the comminuting machine 100.

In this example the middle cage 140 includes a frame 500 having a front side 500F, a back side 500R, lateral sides 500S51, 500S2, a top 500T and a bottom 500B each of which includes a lattice of any suitable number of cross members. The lattice frame 500 may be covered with one or more suitable surface panels 197 that may be positioned on the exterior, interior or both of the lattice frame 500 to cover the surfaces or openings in the lattice frame 500. In one exemplary embodiment, the surface panels may be replaceable in any suitable manner. It should be understood that the directional indicators (i.e. front, back, lateral sides, top and bottom) are used for exemplary purposes only and in alternate embodiments the sides of the cage may be directionally referred to in any suitable manner. It should also be understood that while the cage 140 is described with respect to having an open lattice type structure, in alternate embodiments one or more sides of the cage 140 may be substantially solid. For example, in alternate embodiments one or more sides of the cage or surface panels 197 may be constructed of a wall formed with a metal mesh, plates of metal, polymer, composites or other wear and/or puncture resistant materials such as in a monocoque or semi-coque configuration. In other alternate embodiments, where the sides of the cage are formed of plate material, the sides may include one or more windows to allow an operator to observe the comminuting feed material as it passes through the comminuting machine 100.

The lattice frame 500 may use any desired type of structural member(s) such as, for exemplary purposes only angle iron, channel iron, I-beams and bar stock (e.g. having any suitable round, rectangular or other shaped cross section). The covering surface panels 197 may also be of any desired size and configuration such as for example, mild or heat treated plate steel (e.g. having a thickness of about 1/16 inch to about ½ inch or any other suitable thickness), steel panels that are drilled with for example ½ inch diameter (or any other suitable diameter), or expanded steel mesh or any other suitable combination thereof. It should be understood that while the covering surface panels 197 are described herein as being constructed of steel, in alternate embodiments the panels may be constructed of any suitable material capable of substantially containing projectiles ejected from the comminuting machine 100. It should also be understood that the configuration of the cage 140 shown in the figures is merely exemplary, and in alternate embodiments the cage 140 may have any suitable shape or configuration (e.g. while the cage 140 is shown as having a general hexahedron shape, in alternate embodiments the cage may have any other suitable shape). In one exemplary embodiment the cage 140 is located and configured to cover, for example, the housing 130 and extend along at least a portion of the feed chute 110 to cover the feed rollers 120 as shown. In alternate embodiments the cage 140 may be configured to cover more or less of the comminuting machine 100.

In this example, the cage 140 has any suitable width W, length L and height H. Here the front side 500F of the cage 140 includes a front opening having a predetermined width W2 such that front lattice members 550, 551 are disposed on either side of the front opening. The width W2 is sized such that the front side 500F of the cage 140 extends substantially along side of (e.g. straddles), for example, at least a portion of the feed chute 110 and/or feed roller 120. A height of the front opening may be any suitable predetermined height for allowing comminuting feed material to flow down the feed chute 110 and into the feed roller 120 without, for example, substantially contacting the cage 140. In alternate embodiments the front opening of the cage 140 may be configured to act as a funnel so that comminuting feed material enters the feed roller 120 in a predetermined orientation. The front lattice members 550, 551 extend laterally inward towards a centerline of the cage 140 from a respective one of lateral side lattice members 552, 553. The front lattice members 550, 551 may allow the lateral gaps between cage 140 and the components of the comminuting machine 100 to remain small through simple adjustments made to the front lattice members 550, 551 so that desired gaps between the cage 140 and the comminuting machine components are substantially always achieved. In one example, the front lattice members 550, 551 may be laterally slidable substantially in the direction of arrow 198 (FIG. 1) relative to, for example, the feed chute 110, feed roller 120 and/or shredder 130. The front lattice members 550, 551 may be laterally locked (once the opening between the front lattice members 550, 551 is adjusted to the predetermined width W2 to allow for a minimized gap between the front lattice members 550, 551 and the comminuting machine components) in any suitable manner such as with mechanical fasteners and/or welds. In another example, the front lattice members 550, 551 may be adjustably manufactured (e.g. cut to any desired length or extended to any desired length) so that the opening between the front lattice members 550, 551 has any suitable predetermined width, such as width W2, for forming a minimized gap between the comminuting machine components and the front lattice members 550, 551. As may be realized, while the cage 140 may be provided as part of the containment system 140C for newly manufactured comminuting machines, the adjustability of the front lattice members 550, 551 allows for the cage 140 to be retrofitable to any suitable comminuting machine. As an example, the predetermined width W2 may be adjusted at the site of an in-service or preinstalled comminuting machine. In one exemplary embodiment, curtains, such as for example rubber (or other suitable material) skirts, may be hanged from the opening to substantially deflect any comminuting feed material discharged from the opening towards the front or upstream portions of the comminuting machine 100.

Figure 1C:
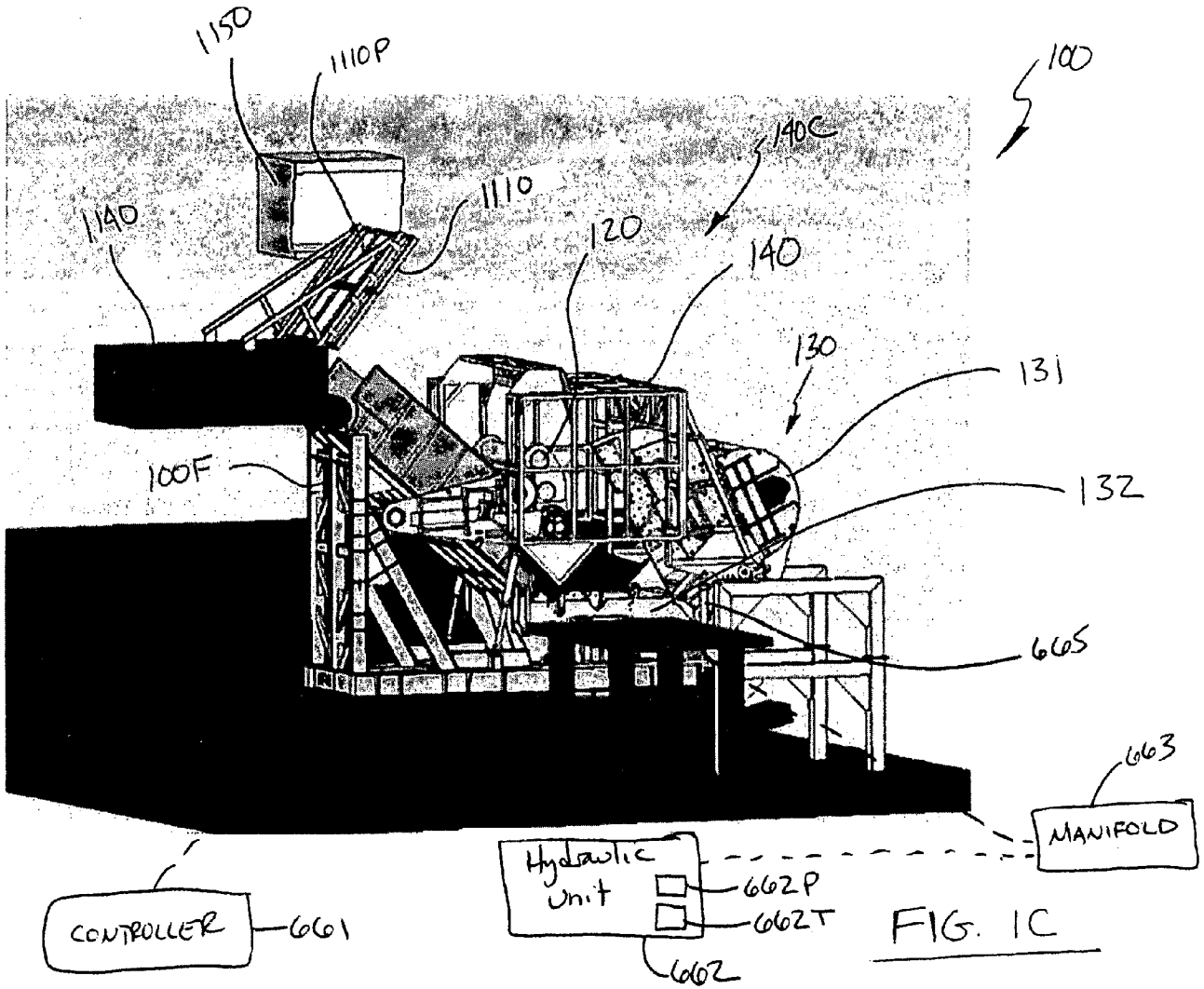

The back side 500R of the cage also includes a back opening having a predetermined width W3 sized to allow the cage 140 to extend substantially along side (e.g. straddle) the shredder housing 130H such that back lattice members 554, 555 are disposed on either side of the back opening. The back lattice members 554, 555 extend laterally inwards from the lateral side lattice members 552, 553 towards the centerline of the cage 140 and may be adjustable in a manner substantially similar to that described above with respect to the front lattice members 550, 551 for providing a minimized gap between the back lattice members 554, 555 and the shredder housing 130H. Here the back side 500R of the cage 140 includes a central lattice portion 559 that connects the back lattice members 554, 555 to form the back opening. In one example, the back opening of the cage may be suitably sized to allow the upper housing portion 131 of the shredder 130 to open/close (e.g. pivot or otherwise move) relative to the lower housing portion 132 while the cage 140 is closed for allowing access to the castings 400 and rotor 300 as best seen in FIG. 1C. As may also be realized, the central lattice portion 559 may be adjustable substantially in the direction of arrow 196 in a manner substantially similar to that described above with respect to front lattice members 550, 551 to obtain any suitable gap between the central lattice portion 559 and the shredder housing 130H. The back side 500R of the cage 140 may also include at least one extension 598, 599 that extends substantially longitudinally (e.g. front to back) away from respective back lattice members 554, 555. Each of the at least one extensions 598, 599 may include a mounting structure 580 for movably attaching the cage 140 to, for example, the frame 100F of the comminuting machine 100. In alternate embodiments the cage 140 may be attached to any suitable part of the comminuting machine 100 including, but not limited to, the shredder 130, feed roller 120 and infeed chute 110. As may be realized, the at least one extension 598, 599 may be adjustable laterally substantially in the direction of arrow 198, longitudinally substantially in the direction of arrow 199 and/or vertically (e.g. from top to bottom of the comminuting machine 100) substantially in the direction of arrow 196 to allow for mounting of the cage 140 to any suitable portion of the comminuting machine component(s), frame 100F and/or foundation of the comminuting machine 100. In one example, the at least one extension 598, 599 may be cut to length, extended or laterally moved in any suitable manner. In other examples, the at least one extension member 598, 599 may be movably adjustable relative to, for example, the remainder of the cage 140 along one or more axes (e.g. in the directions of arrows 198, 199, 196) such that the at least one extension member 598, 599 is locked in place in any suitable manner such as by mechanical fasteners or welds.

The top side 500T of the cage includes a top lattice member 556. In one exemplary embodiment, the top lattice member 556 may include an extension portion 500TE that adds an additional height H2 to the front opening for allowing comminuting feed material to travel down the feed chute 110 into the feed roller 120 substantially without contacting the cage 140. In alternate embodiments the top lattice member 556 may be substantially flat. The bottom 500B of the cage is substantially open to allow the cage to be positioned over at least a portion of one or more of the feed chute 110, feed roller 120 and the shredder 130.

As may be realized, the shape and size of the cage 140 described herein is exemplary only such that the cage may have any suitable shape and size for substantially containing comminuting feed material within the comminuting machine 100 as the comminuting feed material passes along exposed pathways between one or more of the feed chute 110, the feed roller 120 and the shredder 130.

Figure 6A:
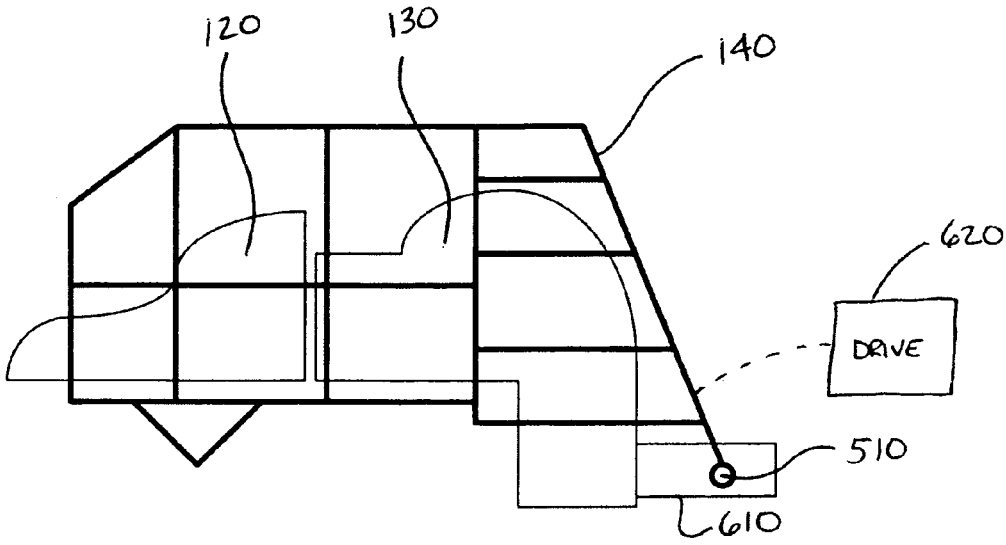
FIGS. 6A and 6B are schematic illustrations of a portion of a comminuting machine in accordance with an exemplary embodiment.
Figure 6B:
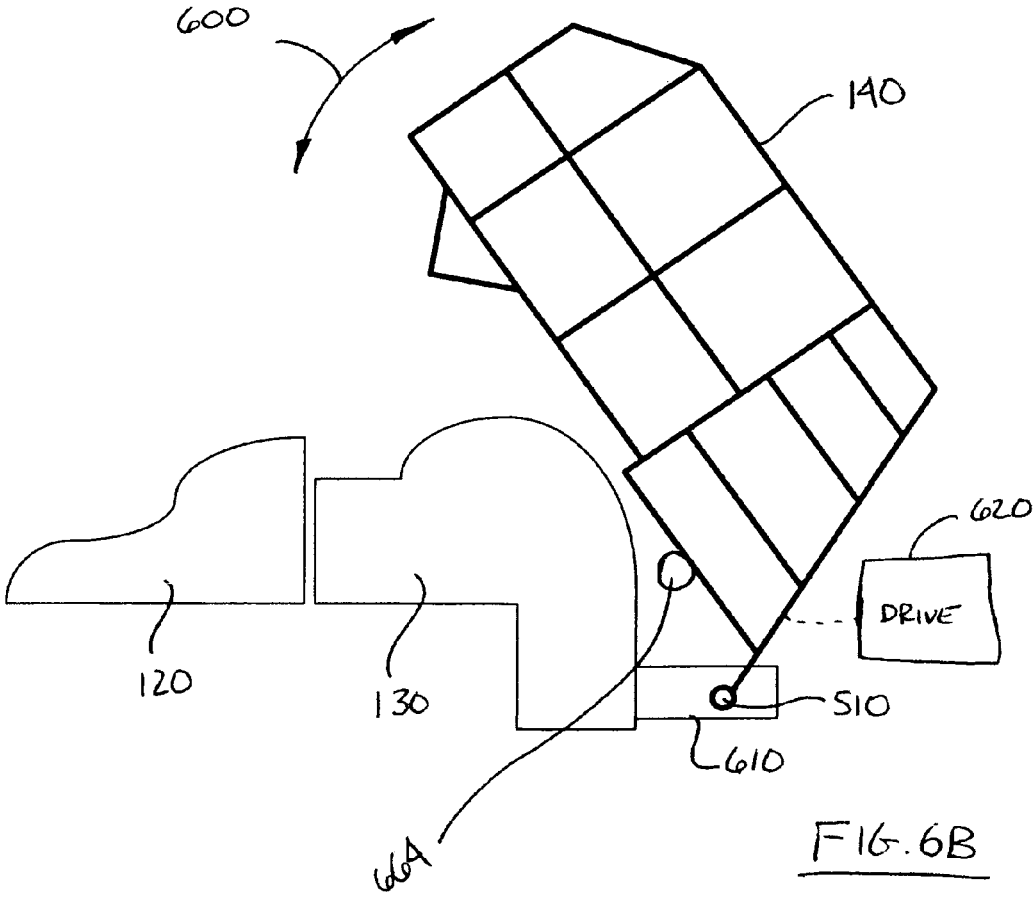
Figures 7A, 7B:
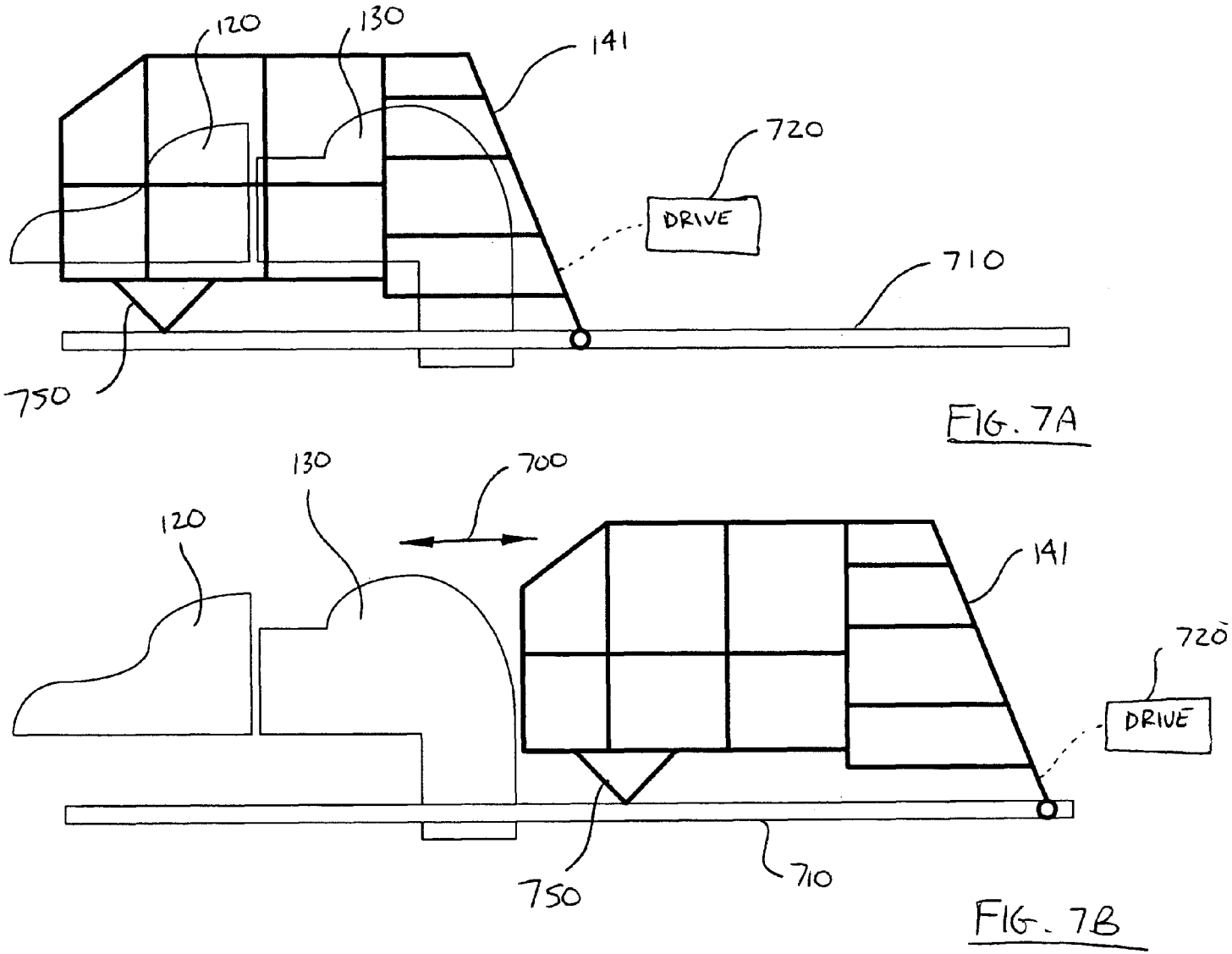
FIGS. 7A and 7B are schematic illustrations of a portion of a comminuting machine in accordance with an exemplary embodiment.

Referring to FIGS. 6A and 6B the cage 140 may be movably (e.g. pivotally) mounted to, for example, a portion 610 of frame 100F. In this example, the frame 100F may include a cage mount 610 extending from the frame 100F adjacent the shredder 130. The mounting structure(s) 580 of the cage 140 may include suitable bearings and/or surfaces for pivotally coupling the cage 140 to corresponding mounting features of cage mount 610 at for example axis 510. A stop structure 577 such as for example, a suitable impact bumper or any other suitable shock absorbing device or mechanism may be disposed on the comminuting machine. The stop structure may be located and configured to absorb desired impact energy that may be produced as the cage 140 is lowered to a closed position. In alternate embodiments the mounting structure(s) 580 of the cage 140 may be configured for movably mounting the cage 140 to corresponding mounting features of the shredder 130 (or any other suitable component of the comminuting machine 100). In one exemplary embodiment, the cage 140 may include locking mechanisms 664 suitably configured (e.g. a mechanical latch movable to engage/release a complementing detent) to securely hold the cage in, for example, the open position. In one example, the locks 664 may be hydraulic, mechanical or electrically (or any combination thereof) operated locks. The locks may be from a common hydraulic, or electro-mechanical power source used for actuation of the cage(s) and/or comminuting machine. The locks 664 may be operated by, for example a single operator from, for example, a remote location such as operator station 1150 (FIG. 12) or any other suitable location. In alternate embodiments, the lock may have any other suitable configuration, such as a hydraulic or electro-magnetic lock.

In this example, the comminuting machine 100 may include at least one drive 620 coupled to the cage 140. The at least one drive 620 may be any suitable linear or rotary drive. In one example the drive 620 may be a hydraulic drive, a pneumatic drive, an electric drive, a hybrid electric-hydraulic or electric-pneumatic drive or any other suitable drive or combination of drives. For exemplary purposes only, the drive may include at least one hydraulic cylinder 665 (FIG. 1C) for opening and closing the cage 140. In one example, there may be a hydraulic cylinder disposed on each lateral side of the cage 140. The hydraulic cylinders for opening and closing the cage 140 may, in one example, be interchangeable with hydraulic cylinders for opening and closing the housing portion 131 of the shredder 130. The at least one hydraulic cylinder 665 may include cross over relief or counterbalance valves to substantially prevent the cage 140 from falling or closing without control during operation in the event of a hydraulic system malfunction such as a burst hose. The containment system may also include any suitable manifold 663 for connecting the containment system hydraulic cylinders and other hydraulic powered components (e.g. latches) to the hydraulic power unit 662 of the comminuting machine for operating the at least one hydraulic cylinder 665. The manifold 663 may be disposed adjacent or on (or disposed at any suitable position relative to) the comminuting machine 1100 and feed into, for example, pressure lines 662P and tank lines 662T on a hydraulic power unit 662 used to operate for example the hydraulic components of the comminuting machine (e.g. the shredder, feed rollers, etc.). In alternate embodiments the cage may have a substantially dedicated hydraulic power unit distinct from a hydraulic unit used to power the remainder of the comminuting machine 1100. The hydraulic manifold 663 may be provided with desired control valves (e.g. solenoid operated valves) that may be communicably connected to a controller (as will be described further below) in order to effect remote operation (e.g. opening/closing, locking/unlocking) of the containment system cases. Each feed line from the manifold may have a control valve for independent flow control. Control valves may be provided with suitable interlocks to prevent undesired actuation, such as cycling of a feed valve to a hydraulic cylinder opening the cage prior to actuation of the locks locking the cage in the open position. In this example, the drive 620 may be configured to effect rotation of the cage 140 about axis 510 so that the front side 500F of the cage pivots longitudinally in the direction of arrow 600 for allowing access to at least one of, for example, the feed chute 110, the feed roller 120 and shredder 130. In alternate embodiments, the cage 140 may be configured to be manually moved relative to the comminuting machine components. For example, there may be a cable/chain and pulley arrangement coupled to the cage 140 to provide suitable leverage to allow an operator to move the cage manually relative to the components of the comminuting machine in a manner substantially similar to those described herein.

In one exemplary embodiment, the containment system may also include a controller 661 which may be common with the controller operating the comminuting machine, or may be a separate controller that may be communicably linked to the machine controller (see for example FIG. 1C). The controller may be disposed at any suitable location(s) relative to the comminuting machine. In one example, the controller may be disposed at least partly within the operator station 1150. In another example, the comminuting machine 1100 may include a remote controller or control stations disposed at other locations on the comminuting machine that work in conjunction with the controller 661 so that the comminuting machine and its components can be operation from any suitable operating position. In one example, the controller 661 may include any suitable programmable logic controller configured to operate the various components of the comminuting machine including but not limited to solenoid valves, proximity sensors and proximity switches. For example, the comminuting machine may include one or more sensors and/or switches configured to interface with the cage 140. The controller 661 may be configured to substantially prevent opening the cage 140 during operation of the comminuting machine 1100. As may be realized, the comminuting machine 1100 may include any suitable interlocks for substantially preventing opening any portion of the comminuting machine (including the cages described herein) during operation.

In another exemplary embodiment referring to FIGS. 1A-1C, 7A and 7B a cage 141 may be mounted to, for example, the frame 100F so that the cage is substantially linearly movable relative to the frame 100F. It is noted that the cage 141 may be substantially similar to cage 140 described above with respect to FIGS. 1A-1C, 5, 6A and 6B. In this example, the frame 100F may include any suitable track or rail such as track 710. Here the mounting structure(s) 580 may be configured to slidingly engage the track 710 for allowing longitudinal movement of the cage 141 bi-directionally in the direction of arrow 700 to open and close the cage 141. Here the cage 141 may also include one or more supports 750 disposed towards the front 500F of the cage 140. The supports 750 may be configured to slidingly engage, for example, track 710 (or any other suitable track) in substantially the same manner as mounting feature(s) 580 for allowing movement of the cage relative to the frame 100F in the direction of arrow 700. In alternate embodiments, the mounting features 580 may be configured to support the cage 141 in a cantilevered manner as the cage 141 moves along the track 710. The relative movement of between the cage 141 and frame 100F may encompass any suitable predetermined distance sufficient to allow access to at least one of the feed chute 110, the feed roller 120 and the shredder 130 or any other suitable component(s) of the comminuting machine 100. In this example, a drive 720 may be connected to the cage 141 for effecting the movement of the cage 141 along the track 710. The drive 720 may be substantially similar to drive 620 described above. In alternate embodiments the movement of the cage 141 along the track 710 may be effected in any suitable manner. Though in the exemplary embodiments shown, the cage 141 is illustrated as being movable substantially linearly in the direction of arrow 700, in alternate embodiments the cage 141 may be configured to be movable relative to the frame 100F in more than one direction (e.g. compound movement that is a combination of linear lateral and/or longitudinal movement and/or pivotal movement substantially similar to the motion shown in FIGS. 6A, 6B and 8A-9B) or any other desired combination of motions. In alternate embodiments, one or more portions of the cage 141 may be configured to, for example, pivot relative to the remainder of the cage 141. For exemplary purposes only, the sides of the cage 141 may be, for example, hinged to the top of the cage 141 so that the sides pivot relative to the top of the cage 141 while the entirety of the cage is linearly movable substantially in the direction of arrow 700.

Figure 8A:
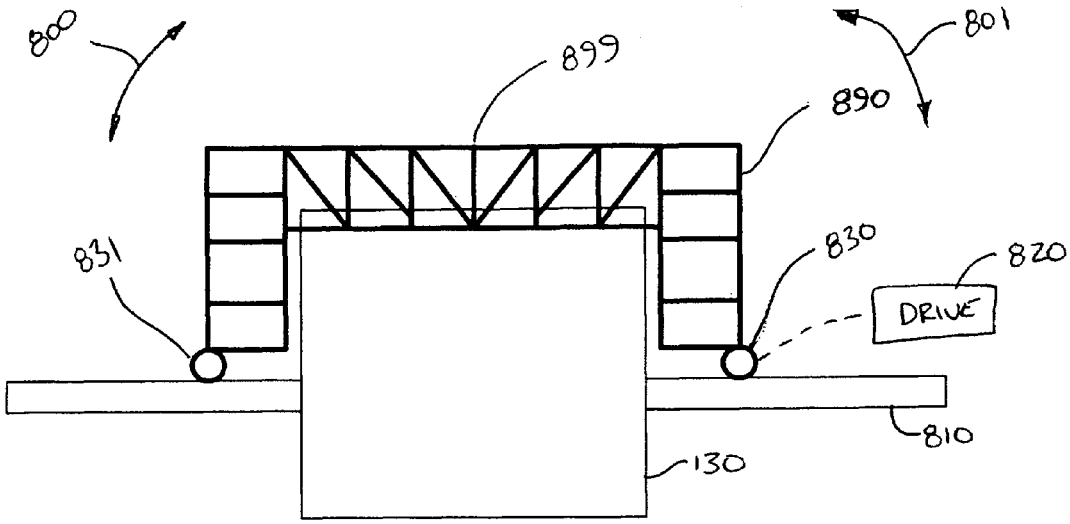
FIGS. 8A and 8B are schematic illustrations of a portion of a comminuting machine in accordance with an exemplary embodiment.
Figure 8B:
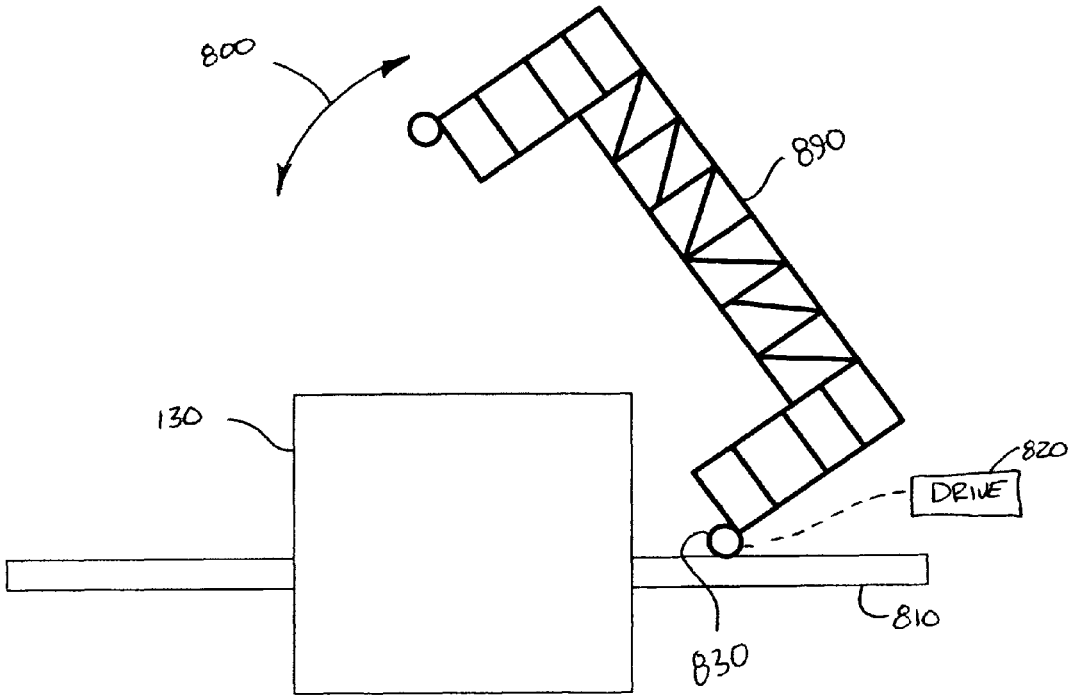
Figure 9A:
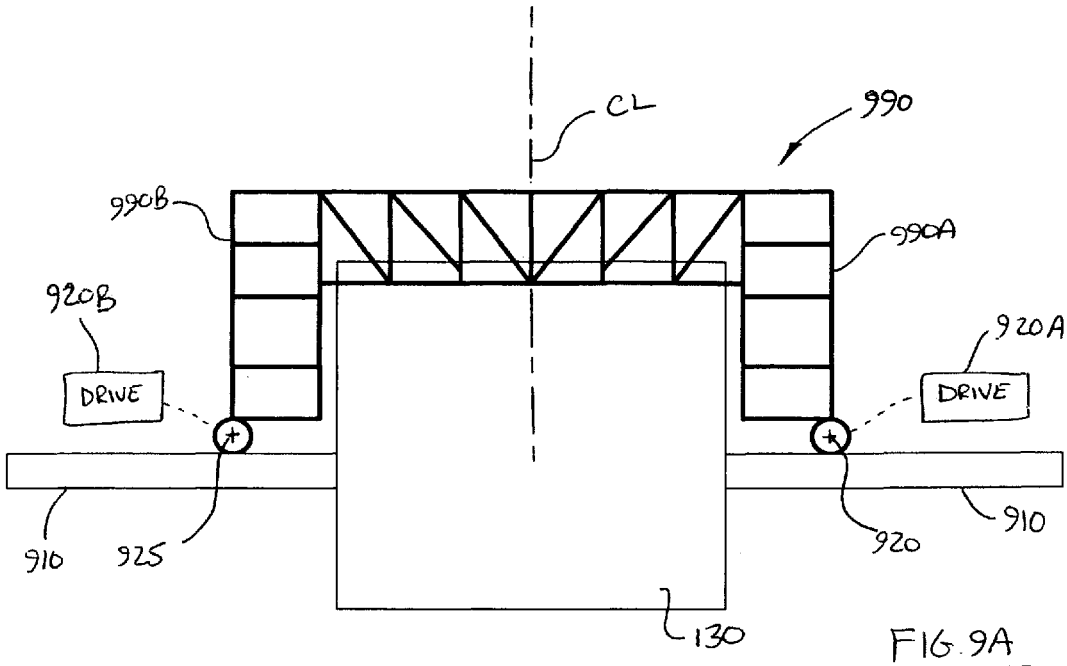
FIGS. 9A and 9B are schematic illustrations of a portion of a comminuting machine in accordance with an exemplary embodiment.
Figure 9B:
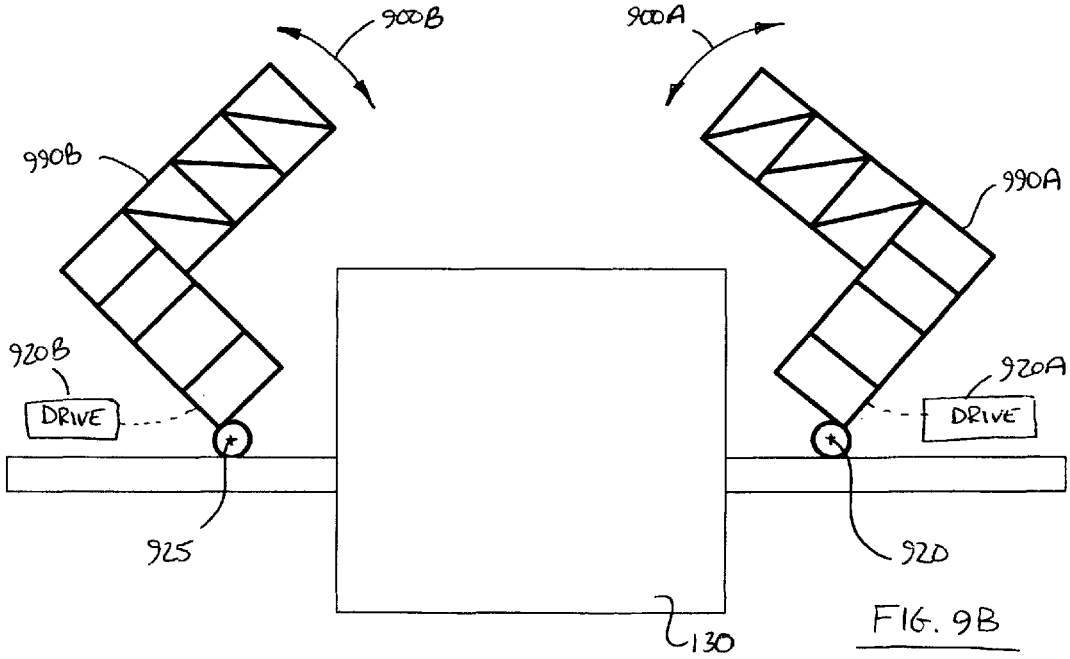
Figure 10A:
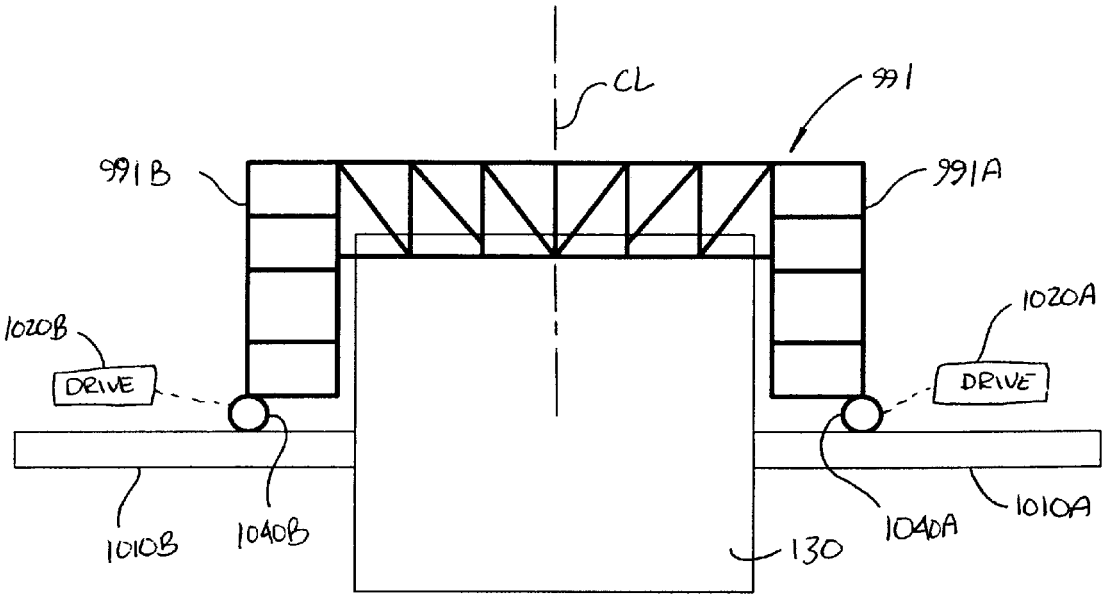
FIGS. 10A and 10B are schematic illustrations of a portion of a comminuting machine in accordance with an exemplary embodiment.
Figure 10B:
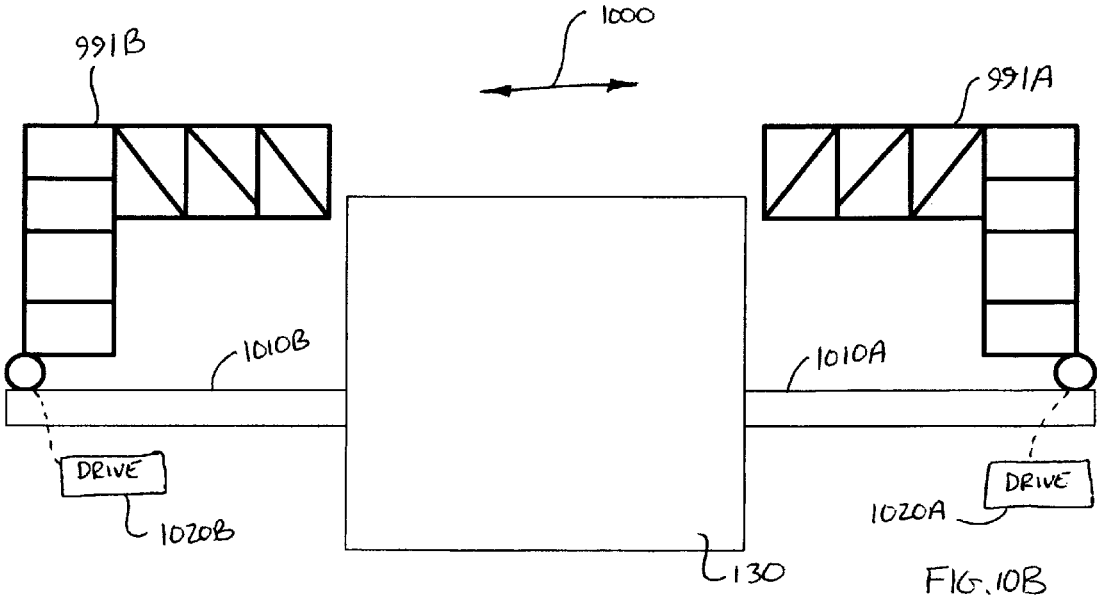

Referring to FIGS. 8A and 8B, another exemplary cage 890 is shown in accordance with an exemplary embodiment. Referring also to FIGS. 1A-1C, it is noted that FIGS. 8A and 8B illustrate the shredder 130 and cage 890 looking towards a rear of the comminuting machine in the direction of arrow 199. In this example the cage 890 may be substantially similar to cage 140 described above, however, in this example, the cage may be configured to pivot laterally relative to the comminuting machine 100. In this example, the frame 100F may include at least one laterally extending support 810 on which the cage 890 is disposed. In alternate embodiments the cage may be supported on the frame 100F in any suitable manner. The cage 890 may include a pivotal coupling 830 on a first lateral side of the cage 890 for pivotally coupling the cage 890 to, for example, support 810. Any suitable drive 820 of the comminuting machine 100 may be connected to the cage 890 for laterally pivoting the cage 890 in, for example, the direction of arrow 800 for allowing access to at least one of the feed chute 110, the feed roller 120 and the shredder 130 or any other suitable component(s) of the comminuting machine 100. In one example, the drive 820 may be substantially similar to drive 620 described above.

Still referring to FIGS. 1A-1C, 8A and 8B, in other exemplary embodiments, the pivotal coupling 830 may be a releasable coupling. Here the cage 890 may include a second releasable pivotal coupling 831 on a second, opposite lateral side of the cage 890. The releasable pivotal couplings 830, 831 may be selectably releasable so that the cage 890 may be bi-directionally pivoted laterally relative to, for example, the shredder 130 (or other suitable components of the comminuting machine 100) in the direction of arrows 800 and 801. As may be realized, in this exemplary embodiment, the drive 820 may be configured to effect the bi-directional lateral pivoting of the cage 890 in any suitable manner. In alternate embodiments, there may be more than one drive connected to the cage 890 for effecting the bi-directional pivoting of the cage 890. For example, there may be a drive connected to the cage at each of the releasable pivotal couplings 830, 831 for effecting pivoting of the cage in a respective one of directions 800, 801. As may be realized the cage 890 may be configured for compound movement (e.g. a combination of lateral, longitudinal and/or pivotal movement) relative to the frame 100F substantially in the manner described above with respect to cage 141. As described above, the cage 890 may also include hinged portions that are pivotal relative to the remainder of the cage 890. For example, in one alternate embodiment the cage 890 may have an articulated constructed. For example, the cage may have cage halves so that each half is hinged to the other half at for example, a centered point such as point 899. In this alternate embodiment, one half of the cage may pivotally fold over the other half of the cage so that substantially only one side of the comminuting machine components is exposed. Also in this alternate embodiment, the folded cage may be further pivoted, in a manner substantially similar to that shown in FIGS. 8A and 8B, to expose substantially the entirety of the comminuting machine is exposed. In other alternate embodiments the cage may have any suitable hinged configuration for allowing access to any suitable portion(s) of the comminuting machine components. As may be realized the cages described herein may include suitable drives or manual pulley/hoist systems for allowing the compound movements of the cages as described herein.

Referring now to FIGS. 1A-1C, 9A and 9B another exemplary cage 990 is shown in accordance with an exemplary embodiment. The cage 990 may be substantially similar to cage 140 described above, however, in this exemplary embodiment the cage may be split into a first section 990A and a second section 990B. Here the cage 990 is split along, for example, a centerline CL of the cage 990 to form the first and second sections 990A, 990B. In alternate embodiments the cage may be split in any suitable location(s) to form any suitable number of cage sections that operate in a manner substantially similar to sections 990A, 990B described herein. In this example, the first cage section 990A is connected to, for example, a laterally extending support 910 of the frame 100F by pivotal coupling 920. The support 910 may be substantially similar to support 810 described above with respect to FIGS. 8A and 8B. The second cage section 990B may be connected to the support 910 by pivotal coupling 925. In alternate embodiments, the cage sections 990A, 990B may be pivotally coupled to any suitable components of the comminuting machine 100 in any suitable manner. A first drive 920A may be connected to the first cage section 990A in any suitable manner for effecting pivoting of the first cage member 990A about coupling 920 in the direction of arrow 900A. A second drive 920A may be connected to the second cage member 990A in any suitable manner for effecting pivoting of the second cage member 990B about coupling 925 in the direction of arrow 900B. The first and second drives 920A, 920B may be substantially similar to drive 620 described above. It should be understood that while each cage section 990A, 990B is described as having a respective drive 920A, 920B in alternate embodiments the cage sections may be driven by a single drive having any suitable transmission connecting the drive to each cage section. In this example, the first and second cage section 990A, 990B pivot laterally in substantially the same manner that a clamshell opens and closes to allow access to at least one of the feed chute 110, the feed roller 120, and the shredder 130 or any other suitable component(s) of the comminuting machine 100. It should be understood that each of the cage sections 990A, 990B may be individually operable for allowing access to comminuting machine components located adjacent a respective cage section. As may be realized, the cage 990 may be configured for compound movements as described above with respect to FIGS. 6A-8B. As may also be realized the cage 990 may be constructed as an articulated cage in a manner substantially similar to that described above with respect to FIGS. 8A-8B. As also described above the compound and/or articulated motions of the cage may be powered motion or manual motion (e.g. through pulley systems or other suitable manual drive).

In another exemplary embodiment, referring to FIGS. 1A-1C, 10A and 10B, a split cage 991 may be configured to slide laterally for allowing access to at least one of the feed chute 110, the feed roller 120 and the shredder 130 or any other suitable component(s) of the comminuting machine 100. It is noted that the cage 991 may be substantially similar to cage 990 described above with respect to FIGS. 9A, 9B. In this example, the frame 100F of the comminuting machine 100 may include tracks 1010A, 1010B extending laterally from the frame away from a centerline CL of the cage 991. In alternate embodiments the tracks may extend from any suitable component(s) of the comminuting machine 100. A first section 991A of the cage 991 may include at least one mounting structure 1040A. In this example, the mounting structure 1040A may be configured to slidingly couple the first section 991A to the track 1010A for allowing lateral movement of the first section 991A in the direction of arrow 1000. The mounting structure 1040A may be configured to substantially resist any moment on the first section 991A due to, for example, the cantilevered extension of the cage 991 over at least one of the feed chute 110, the feed roller 120 and the shredder 130. In alternate embodiments, the comminuting machine 100 may include any suitable guide rails or supports for substantially preventing rotation of the first section 991A about mounting structure 1040A. A first drive 1020A may be connected to the first section 991A in any suitable manner for effecting lateral movement of the first section 991A along the track 1010A for allowing access to at least one of the feed chute 110, the feed roller 120 and the shredder 130 or any other suitable component(s) of the comminuting machine 100. The second section 991B of the cage 991 may be substantially similar to the first section 991B. For example, the second section 991B may include a mounting structure 1040E configured to slidingly couple the second section 991B to the track 1010B for allowing lateral movement of the second section 991B in the direction of arrow 1000. The mounting structure 1040B may be substantially similar to mounting structure 1040A described above. A second drive 1020B may be connected to the second section 991B for effecting lateral movement of the second section 991B along track 1010B in the direction of arrow 1000. It is noted that the first and second drives 1020A, 1020B may be substantially similar to drive 620 described above. It is also noted that while each cage section 991A, 991B is described as having a respective drive 1020A, 1020B in alternate embodiments the cage sections may be driven by a single drive having any suitable transmission connecting the drive to each cage section. As may be realized, the cage 991 may be configured for compound movements as described above with respect to FIGS. 6A-8B. As may also be realized the cage 991 may be constructed as an articulated cage in a manner substantially similar to that described above with respect to FIGS. 8A-8B. As also described above the compound and/or articulated motions of the cage may be powered motion or manual motion (e.g. through pulley systems or other suitable manual drive).

Referring now to FIGS. 11A-11D another exemplary containment system 1340C is shown in accordance with an exemplary embodiment. The containment system 1340C (and comminuting machine 1100) may be substantially similar to containment system 140C described above with respect to FIGS. 1A-6B unless otherwise noted. Here the middle cage 1340 is substantially similar to middle cage 140 but in this example, the cage 1340 is pivotable about a point disposed towards the front portion 1100F of the comminuting machine 1100. At least one extension arm or frame 1310 may be pivotally mounted to foundation plinths by, for example, pivot clamps 1315 for allowing the bi-directional pivotal movement of the cage 140 (which is mounted on the at least one extension arm 1310) in the direction of arrow 1399. The cage 1340 may be mounted to the at least one extension arm 1310 in any suitable manner, such as with fasteners, welds, etc. In this example, there may be an extension arm 1310 adjacent to and extending along at least part of each lateral side of the comminuting machine 1100 for supporting the cage 1340 as will be described below. The at least one extension arm may have any suitable configuration and be constructed of any suitable materials in any suitable manner. For exemplary purposes only the at least one extension arm 1310 is shown in FIGS. 11A-11D as having a dog leg truss configuration. In one example, foundation plinths 1316 may be disposed substantially between the feed chute 110 and infeed conveyor 1140 while in other examples, the foundation plinths may be disposed at any suitable location relative to the comminuting machine 1100. A torque tube 1318 (that may be positioned or configured such as to assist in lifting and lowering the cage 1340 by substantially reducing the perceived weight of the cage as seen by, for example, hydraulic cylinders 665) with split pillow blocks 1317 and a suitable bushing may be included in the pivoting arrangement. Hydraulic cylinders, such as cylinders 665 may be connected to the at least one extension arm 1310 and any suitable part of the comminuting machine such as the foundation or frame for effecting the pivoting of the at least one extension arm 1310 and the cage 1340 which is disposed on the at least one extension arm 1310. In alternate embodiments, any suitable lifting, rotating or other movement device (hydraulic, pneumatic, electrical, or any combination thereof) may be used to effect pivoting of the cage in the direction of arrow 1399.

Figure 12:
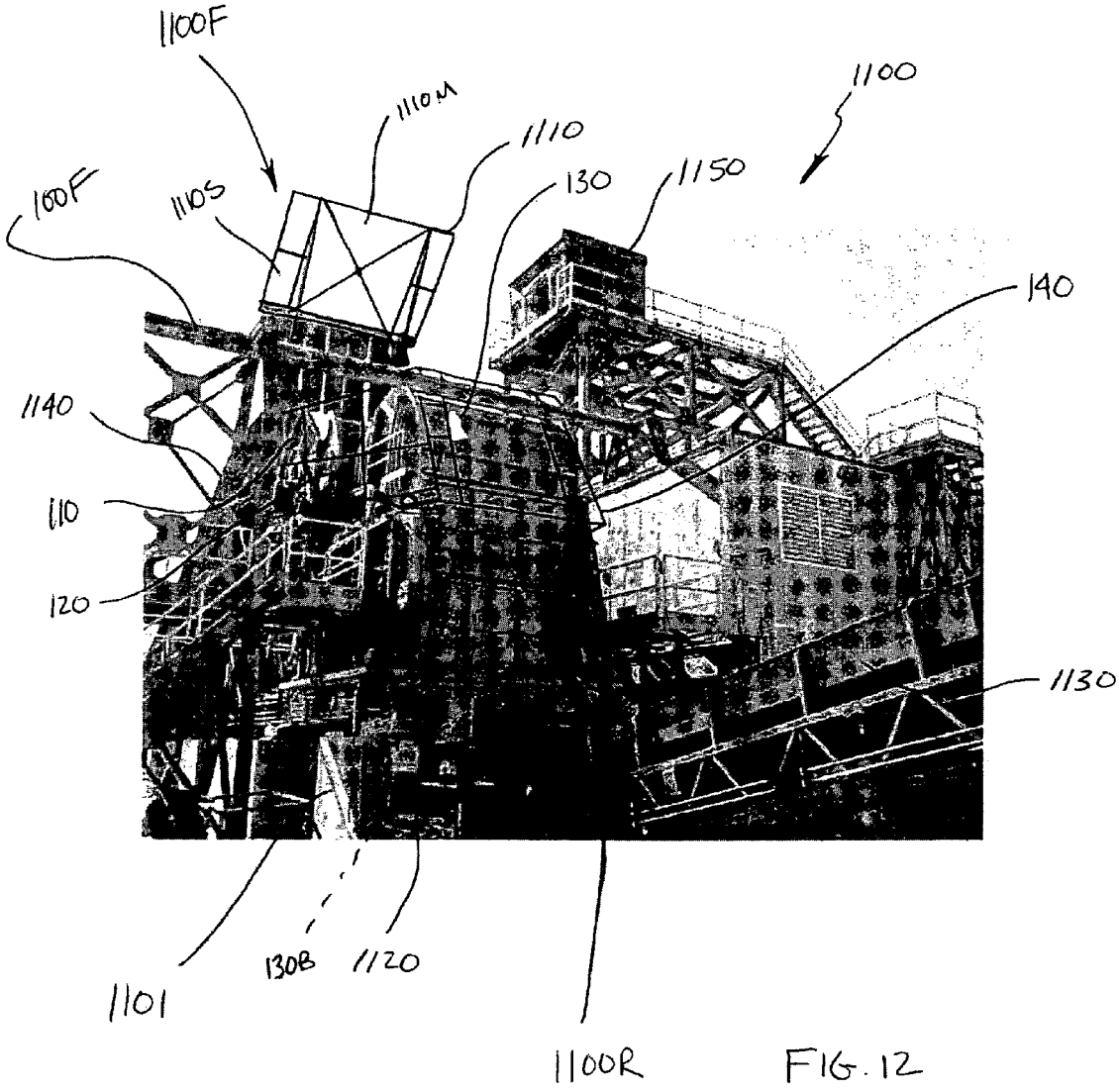
FIG. 12 illustrates a comminuting machine in accordance with an exemplary embodiment.
Figure 13:
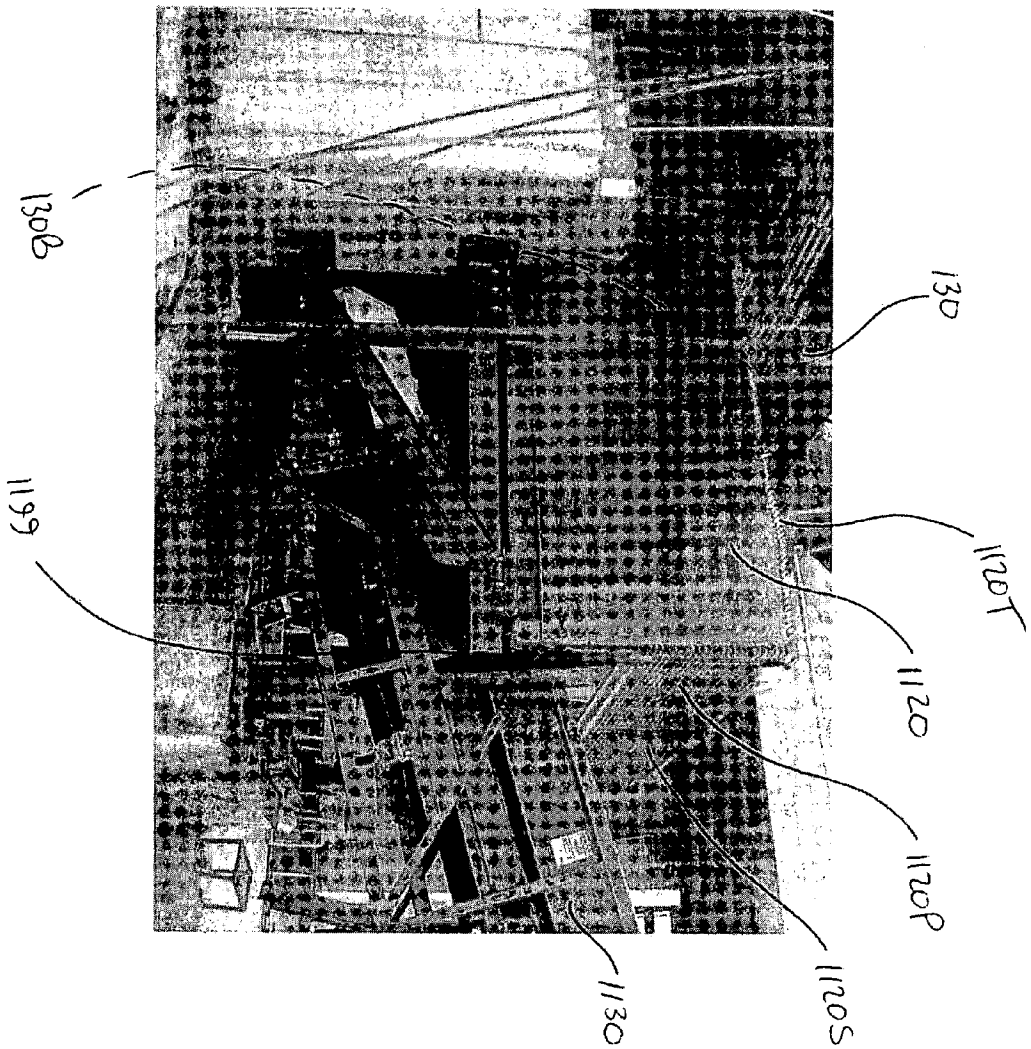
FIG. 13 illustrates a portion of a comminuting machine in accordance with an exemplary embodiment.

Referring now to FIGS. 12 and 13, an exemplary comminuting machine 1100 is shown having a containment system, such as containment system 140C, incorporating one or more aspects of the exemplary embodiments described herein. Here, the comminuting machine may be substantially similar to that described above with respect to FIG. 1A-1C. For example, the comminuting machine 1100 includes frame 100F supported on a foundation 1101 (or other suitable support). The comminuting machine 1100 includes a feed chute 110 that is fed by an infeed conveyor 1140, a feed roll 120, a shredder 130, an outfeed conveyor 1130, a cage 140 and one or more suitable drive units for driving the conveyors 1140, 1130, feed roll 120, shredder 130 and cage 140.

In one exemplary embodiment, the comminuting machine may include one or more of an operator station 1150, an upper cage 1110 and a rear cage 1120. The operator station 1150 is suitably positioned on the frame to allow an operator of the comminuting machine 1100 a substantially unobstructed view of the operation of the comminuting machine components. The upper cage 1110, which may be part of the containment system, may be any suitable cage or screen. In this example the upper cage 1110 is shown as having a rectangular shape but in alternate embodiments the upper cage 1110 may have any suitable size and shape. In one exemplary embodiment the upper cage 1110 may include replaceable panels 1110P (FIG. 10) coupled to, for example, a steel frame. The panels may be substantially similar to those described above with respect to the cage 140. In one example, the panels may be mesh panels where openings in the mesh may be any suitable size and shape. In alternate embodiments the panels may be constructed of metal plates or any other suitable material capable of containing items ejected from the comminuting machine 1100. In another exemplary embodiment the upper cage 1110 may include a middle panel 1110M and one or more side panels 1110S where the middle panel may extend over, for example, the infeed conveyor 110 while the side panels 1110S extend laterally outward from the middle panel 1110M to provide additional cage area for containing items ejected from the comminuting machine 1100. The upper cage 1110 may be coupled to one or more of, for exemplary purposes only, the frame 100F, the infeed conveyor 1140 and feed chute 110 such that the upper cage 1110 is disposed substantially above at least a portion of the infeed conveyor 1140 and or feed chute 110 for substantially preventing discharge of comminuting feed material being processed by the comminuting machine 1100 from a front portion 1100F of the comminuting machine 1100. In alternate embodiments, the upper cage 1110 may be disposed at any suitable location on the comminuting machine 1100 for substantially preventing discharge of comminuting feed material from the front portion 1100F of the comminuting machine 1100.

Figure 11A:
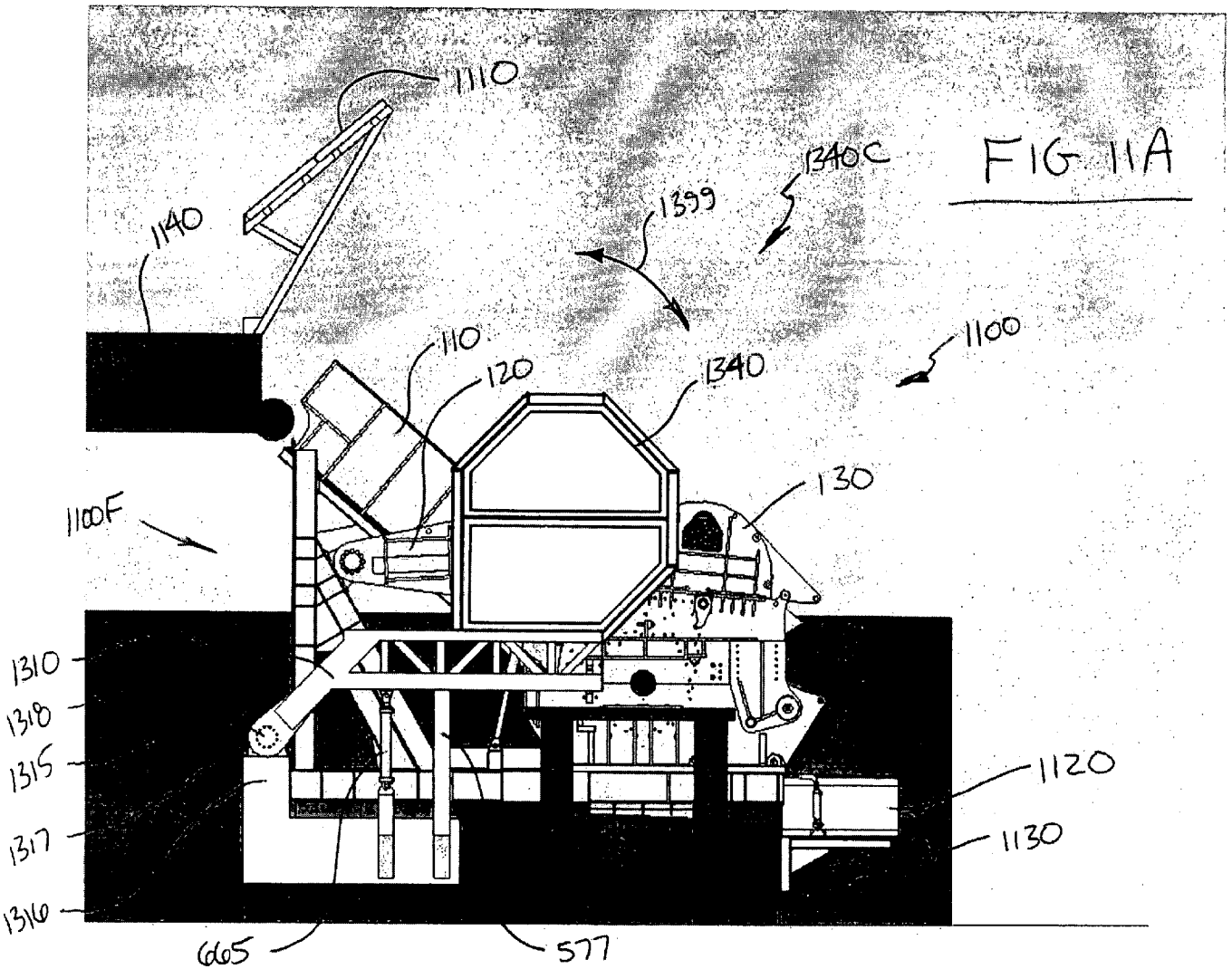
FIGS. 11A-11D illustrate a comminuting machine in accordance with an exemplary embodiment.
Figure 11B:
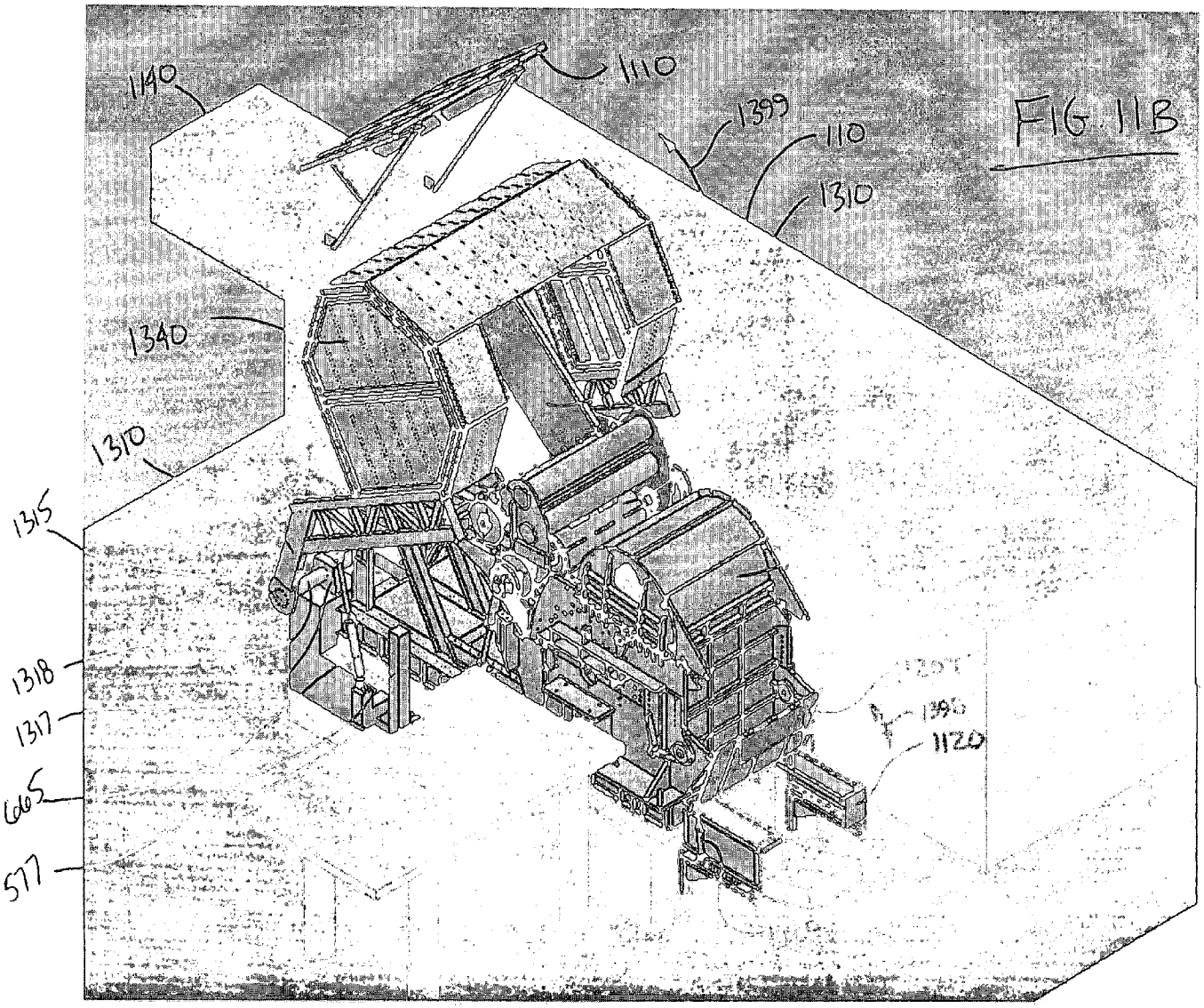
Figure 11C:
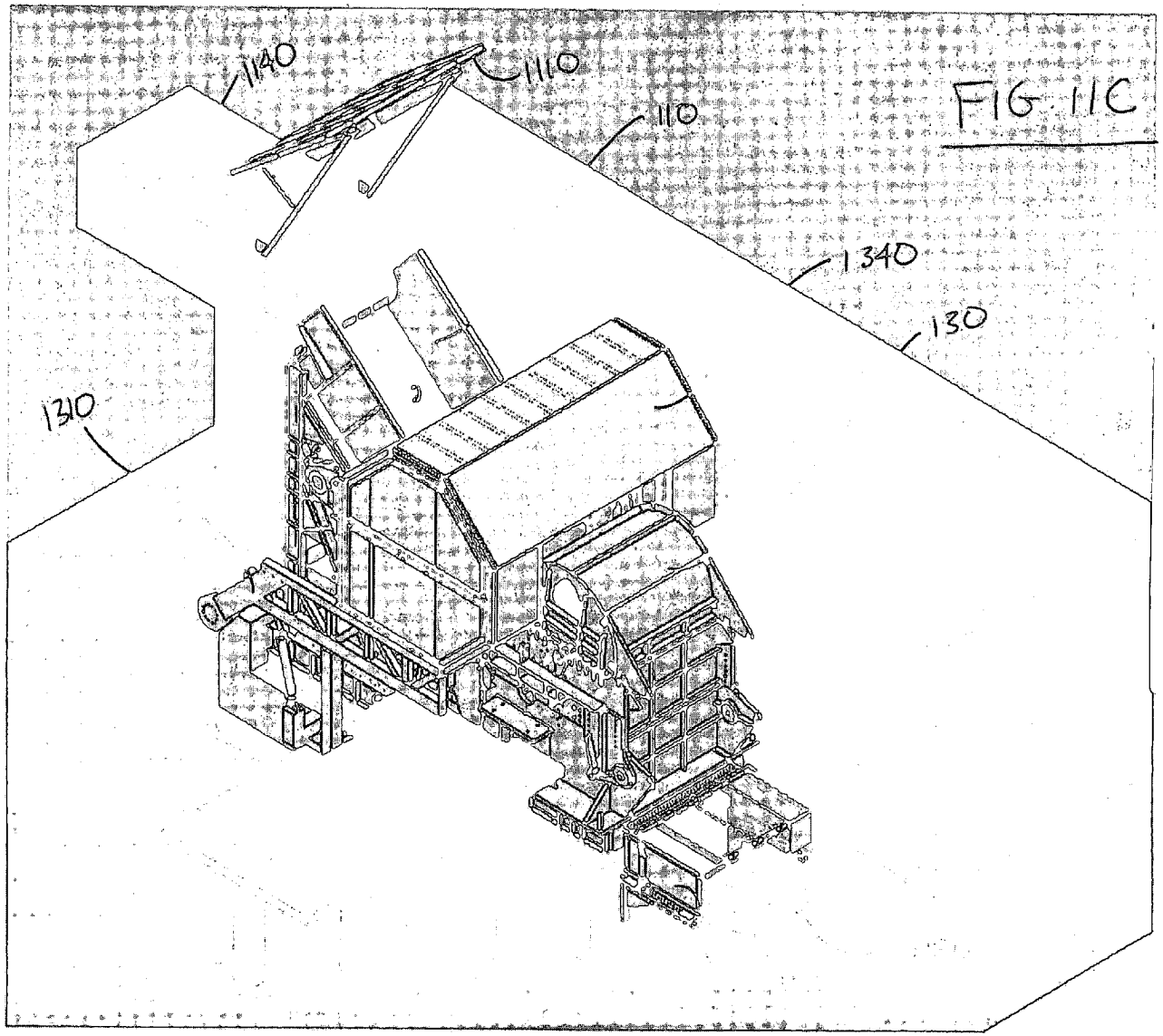
Figure 11D:
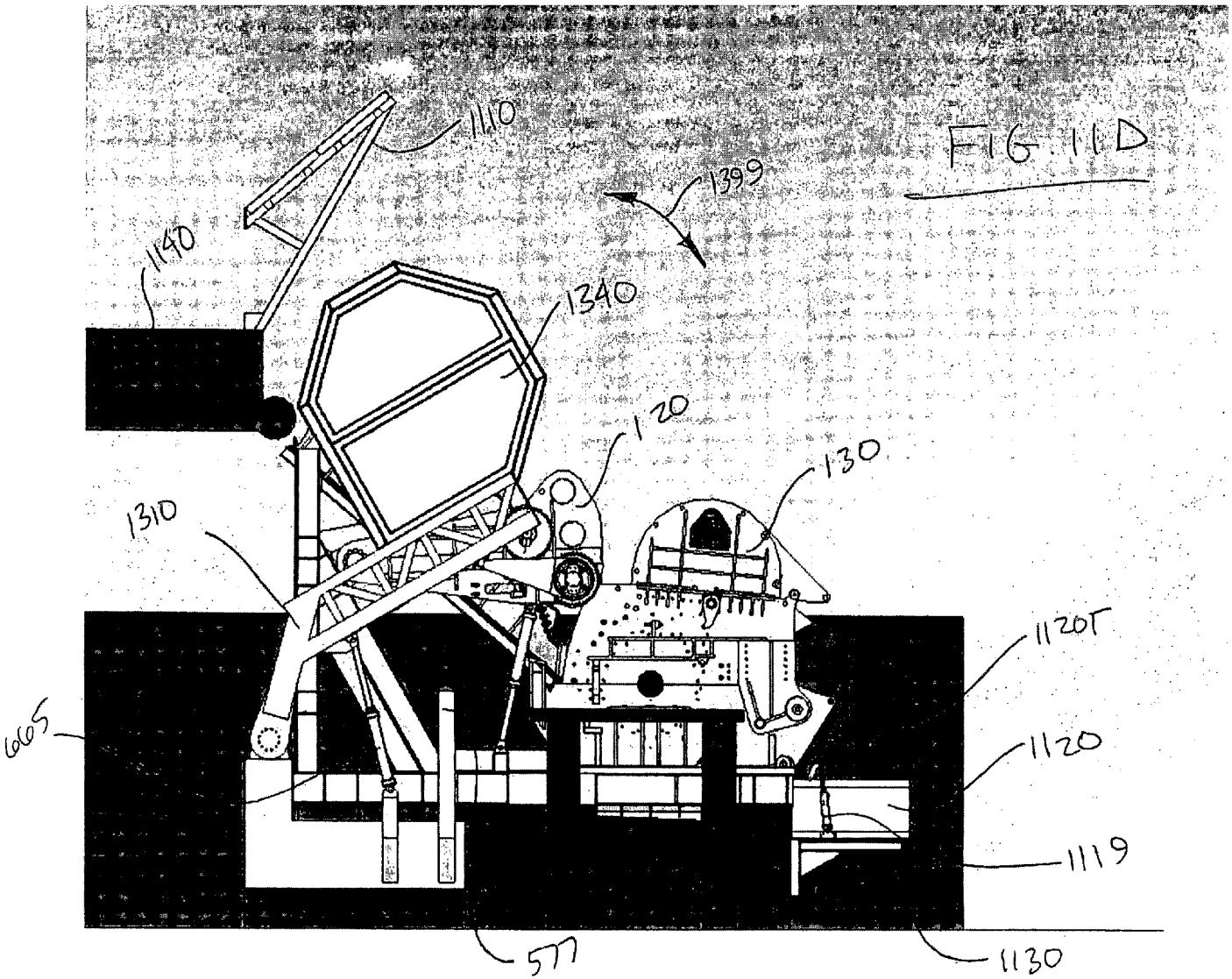

The rear cage 1120, which may be part of the containment system, may be disposed towards a rear portion 1100R of the comminuting machine 1100 adjacent, for exemplary purposes only, the outlet 130B of the shredder 130. In one example, the rear cage 1120 may be disposed at the exit of the shredder 130, above the transition between an under shredder vibrator or oscillator and the conveyor 1130. The rear cage 1120 may include replaceable panels 1120P substantially similar to those described above with respect to the cage 140 and upper cage 1110. In one exemplary embodiment, the panels 1120P of the lower cage (or the other cages 140, 1110) may be hinged relative to the cage frame for allowing access to the area covered by the cage. As may be realized, any suitable portions, such as the sides 1120S and top 1120T, of the rear cage 1120 may be opened and closed in any suitable manner, such as in a manner substantially similar to that described above with respect to cage 140. For example, as can be seen in FIGS. 11B and 11D the top 1120T of the rear cage 1120 may be bi-directionally pivotable in the direction of arrow 1398 via any suitable actuators such as, for example, hydraulic cylinders 1119. As may also be realized, suitable locking devices may be disposed adjacent to or on the rear cage 1120 for holding the rear cage 1120 in an open configuration. In alternate embodiments the whole lower cage may be movable as a unit in a manner similar to the movable cage 140, 1340. In one example, the rear cage 1120 may also extend over at least a portion of the outfeed conveyor 1130 to substantially prevent discharge of comminuting discharge material being processed by the comminuting machine 1100 from exiting the machine by means other than the outfeed conveyor 1130. The rear cage 1120, in this example, is shown as having a box configuration but in alternate embodiments the rear cage 1120 may have any suitable shape and size for substantially preventing undesired discharge of comminuting discharge material from the rear portion 1100R of comminuting machine 1100. The rear cage 1120 may also include suitable curtains 1199, such as rubber (or other suitable material) skirts that hang adjacent the openings of the rear cage 1120 for substantially containing items ejected from the comminuting machine 1100.

It should be understood that the exemplary embodiments described herein may be used individually or in any combination thereof. For example, the cages described herein may include multidirectional couplings that couple the cage to, for example the frame 100F that allow the cage to pivot and/or slide about multiple axes (e.g. laterally and/or longitudinally). It should be understood that the foregoing description is only illustrative of the embodiments. Various alternatives and modifications can be devised by those skilled in the art without departing from the embodiments. Accordingly, the present embodiments are intended to embrace all such alternatives, modifications and variances that fall within the scope of the appended claims.

What is claimed is:

1. A comminuting machine comprising:

a frame;

an infeed conveyor connected to the frame;

a hammer mill connected to the frame, the hammer mill including a hammer mill housing substantially surrounding the hammer mill;

a containment system substantially surrounding a comminuting portion of the comminuting machine, the containment system includes at least one cage, the at least one cage including a cage frame extending to substantially block projectile travel paths through openings of the comminuting machine where the openings include at least one feed opening, the cage frame being connected to the frame; and a drive unit movably coupled to the frame for effecting movement of the at least one cage relative to the comminuting portion of the comminuting machine without disconnecting the cage frame from the frame.

2. The comminuting machine of claim 1, wherein the at least one cage is pivotally connected to the frame for allowing access to the comminuting portion of the comminuting machine.

3. The comminuting machine of claim 2, wherein the at least one cage further comprises a torque tube configured to reduce a perceived weight of the cage as seen by the drive unit to aid in pivotally lifting and pivotally lowering the cage.

4. The comminuting machine of claim 1, wherein the at least one cage is slidably connected to the frame for allowing access to the comminuting portion of the comminuting machine.

5. The comminuting machine of claim 1, further comprising at least one shock absorber configured to absorb impact forces imparted on the frame by the at least one cage.

6. The comminuting machine of claim 1, wherein the at least one cage comprises one or more of a front cage, a movable middle cage and a rear cage, the front cage being disposed substantially at an end of the infeed conveyor opposite the hammer mill, the movable middle cage being disposed adjacent the hammer mill, and the rear cage being disposed adjacent an outlet of the comminuting machine.

7. The comminuting machine of claim 1, further comprising a feed roller disposed between the infeed conveyor and the hammer mill, wherein the at least one cage extends over at least a portion of one or more of the infeed conveyor, feed roller and hammer mill.

8. A method for substantially blocking projectile travel paths in a comminuting machine, the method comprising:

providing an infeed conveyor;

providing a hammer mill, the hammer mill including a hammer mill housing substantially surrounding the hammer mill, the infeed conveyor being disposed adjacent the hammer mill for conveying items to the hammer mill;

substantially blocking projectile travel paths through openings of the comminuting machine by providing a containment system substantially surrounding a comminuting portion of the comminuting machine where the openings include at least one feed opening, the containment system including at least one cage including a cage frame extending to block the projectile travel paths, the cage frame being connected to the comminuting machine; and moving the at least one cage relative to the comminuting portion of the comminuting machine without disconnecting the cage frame from the comminuting machine for allowing access to comminuting machine components.

9. The method of claim 8, wherein the at least one cage is pivotally moved relative to the comminuting portion of the comminuting machine.

10. The method of claim 9, further comprising reducing, with a torque tube, a perceived weight of the cage for aiding in pivotally lifting and pivotally lowering the cage.

11. The method of claim 8, wherein the at least one cage is slidably moved relative to the comminuting portion of the comminuting machine.

12. The method of claim 8, wherein the at least one cage comprises one or more of a front cage, a movable middle cage and a rear cage, the method further comprising substantially blocking projectile travel paths with the front cage disposed substantially at an end of the infeed conveyor opposite the hammer mill, substantially blocking projectile travel paths with the movable middle cage disposed adjacent the hammer mill, and substantially blocking projectile travel paths with the rear cage disposed adjacent an outlet of the comminuting machine, where the movable middle cage allows access to comminuting machine components.

13. A comminuting machine comprising:

a frame;

comminuting machine components mounted to the frame, the comminuting machine components including a hammer mill having a hammer mill housing substantially surrounding the hammer mill;

a containment system substantially surrounding a comminuting portion of the comminuting machine, the containment system includes at least one cage, the at least one cage including a cage frame extending to substantially block projectile travel paths through openings between the comminuting machine components, the cage frame being connected to the frame; and a drive unit movably coupled to the frame for effecting movement of the at least one cage relative to the comminuting machine components without disconnecting the cage frame from the frame;

wherein the at least one cage is configured to allow opening of the hammer mill housing relative to the hammer mill without moving the at least one cage relative to the comminuting machine components.

14. The comminuting machine of claim 13, wherein the at least one cage is pivotally connected to the frame for allowing access to the comminuting portion of the comminuting machine.

15. The comminuting machine of claim 14, wherein the at least one cage further comprises a torque tube configured to reduce a perceived weight of the cage as seen by the drive unit to aid in pivotally lifting and pivotally lowering the cage.

16. The comminuting machine of claim 13, wherein the at least one cage is slidably connected to the frame for allowing access to the comminuting portion of the comminuting machine.

* * * * *